US005254456A

United States Patent [19]

Yamashita et al.

[11] Patent Number: 5,254,456

[45] Date of Patent: Oct. 19, 1993

[54] METHOD OF MANUFACTURING SILVER HALIDE EMULSION

[75] Inventors: Seiji Yamashita; Shunji Takada; Shigeru Shibayama, all of Kanagawa, Japan

[73] Assignee: Fuji Photo Film Co., Ltd., Kanagawa, Japan

[21] Appl. No.: 860,609

[22] Filed: Mar. 30, 1992

Related U.S. Application Data

[63] Continuation of Ser. No. 470,156, Jan. 25, 1990, abandoned, which is a continuation-in-part of Ser. No. 435,283, Nov. 9, 1989, abandoned.

[30] Foreign Application Priority Data

Nov. 18, 1988 [JP] Japan ..... 63-291966
Jan. 25, 1989 [JP] Japan ..... 1-15520

[51] Int. Cl.[5] ..... G03C 1/00; G03C 1/34

[52] U.S. Cl. ..... 430/611; 430/567; 430/569; 430/603

[58] Field of Search ..... 430/567, 569, 564, 603, 430/611

[56] References Cited

U.S. PATENT DOCUMENTS

| | | | |
|---|---|---|---|
| 3,047,393 | 7/1962 | Herz et al. . | |
| 3,892,574 | 7/1975 | Claes et al. . | |
| 3,942,986 | 3/1976 | Florens . | |
| 3,957,490 | 5/1976 | Libeer et al. | 430/603 |
| 4,198,240 | 3/1976 | Mikawa . | |
| 4,276,374 | 6/1981 | Mifune et al. . | |
| 4,439,520 | 3/1984 | Kofron et al. . | |
| 4,459,353 | 6/1984 | Maskasky . | |

FOREIGN PATENT DOCUMENTS

| | | |
|---|---|---|
| 2169360 | 1/1973 | France . |
| 1070301 | 6/1967 | United Kingdom . |

*Primary Examiner*—Charles L. Bowers, Jr.
*Assistant Examiner*—Thorl Chea
*Attorney, Agent, or Firm*—Birch, Stewart, Kolasch & Birch

[57] ABSTRACT

A method of manufacturing a silver halide emulsion, wherein reduction sensitization is performed by using at least one of ascorbic acid and derivatives thereof in a process of manufacturing a silver halide emulsion. The invention is further directed to a of manufacturing a silver halide emulsion, wherein reduction sensitization is performed by using at least one of ascorbic acid and derivatives thereof during precipitation of silver halide grains.

16 Claims, No Drawings

METHOD OF MANUFACTURING SILVER HALIDE EMULSION

CROSS-REFERENCE TO RELATED APPLICATIONS

This application is a continuation of application Ser. No. 07/470,156 filed on Jan. 25, 1990 now abandoned, which is a continuation-in-part of Ser. No. 07/435,283 filed on Nov. 9, 1989 now abandoned.

BACKGROUND OF THE INVENTION

1. Field of the Invention

The present invention relates to a method of manufacturing a silver halide photographic emulsion for providing a light-sensitive material with high sensitivity and low fogging density. The present invention also relates to a method of manufacturing a silver halide photographic emulsion for providing a light-sensitive material whose sensitivity and fogging density do not vary much upon storage.

2. Description of the Related Art

Basic properties required for a photographic silver halide emulsion are high sensitivity, low fogging density, and fine graininess.

In order to increase the sensitivity of an emulsion, (1) to increase the number of photons absorbed by a single grain, (2) to increase the efficiency of converting photoelectrons generated by light absorption into a silver cluster (latent image), and (3) to increase development activity for effectively utilizing the obtained latent image, are required. Increasing the size increases the number of photons absorbed by a single grain but degrades image quality. Increasing the development activity is an effective means of increasing sensitivity. In the case of parallel development such as color development, however, the graininess is generally degraded. In order to increase the sensitivity without degrading graininess, it is most preferable to increase the efficiency of converting photoelectrons into a latent image, i.e., increase a quantum efficiency. In order to increase the quantum efficiency, a low-efficiency process such as recombination and latent image dispersion must be minimized. It is known that a reduction sensitization method of forming a small silver nucleus without development activity inside or on the surface of a silver halide is effective to prevent recombination.

The method of reduction sensitization has been studied for a long time. Carroll, Lowe et al., and Fallens et al. disclose that a tin compound, a polyamine compound, and a thiourea dioxide-based compound are effective as a reduction sensitizer in U.S. Pat. Nos. 2,487,850 and 2,512,925 and British Patent 789,823, respectively. Collier compares properties of silver nuclei formed by various reduction sensitization methods in "Photographic Science and Engineering", Vol. 23, P. 113 (1979). Collier adopted methods of dimethylamineborane, stannous chloride, hydrazine, high-pH ripening, and low-pAg ripening. Reduction sensitization methods are also disclosed in U.S. Pat. Nos. 2,518,698, 3,201,254, 3,411,917, 3,779,777, and 3,930,867. Not only selection of a reduction sensitizer but also improvements in a reduction sensitization method are described in JP-B-57-33572 and JP-B-58-1410 ("JP-B-" means examined Japanese patent application). In these disclosures, conventional reduction sensitizers are enumerated, and ascorbic acid is included therein. In these disclosures, however, a compound such as thiourea dioxide is considered to be preferable, and thiourea dioxide, silver ripening, and hydrazine are exemplified. Therefore, preferable properties of an ascorbic acid compound as a reduction sensitizer have not been yet found. Improvements are also disclosed in JP-A-57-179835 ("JP-A-" means unexamined published Japanese patent application).

In order to realize reduction sensitization, a problem of storage stability must be solved. Techniques of improving storage stability of an emulsion subjected to reduction sensitization are disclosed in JP-A-57-82831 and JP-A-60-178445, but improvements have not reached a sufficient level. Regardless of a number of studies as described above, an increase in sensitivity is insufficient as compared with that obtained in hydrogen sensitization in which a light sensitive material is treated with hydrogen gas in a vacuum. This is reported by Moisar et al. in "Journal of Imaging Science", Vol. 29, P. 233 (1985). A demand has arisen for also improving in storage stability of a light-sensitive material containing a reduction-sensitized emulsion.

The conventional techniques of reduction sensitization do not satisfy a recent demand for high sensitivity and high image quality of a photographic light-sensitive material. This is because, firstly, variations in sensitivity and fogging density are large when a light-sensitive material containing an emulsion subjected to reduction sensitization is stored. Secondly, an increase in sensitivity obtained by reduction sensitization is insufficient.

SUMMARY OF THE INVENTION

It is a first object of the present invention to provide a method of manufacturing an emulsion for providing a light-sensitive material with high sensitivity and low fogging density and, more particularly, to provide a method of manufacturing a light-sensitive material whose sensitivity and fogging density do not vary much upon storage and which has high sensitivity.

It is a second object of the present invention to provide a color light-sensitive material, especially, a color photographic light-sensitive material with high sensitivity and low fogging density in which a performance variation is small upon storage.

It is a third object of the present invention to provide a silver halide color photographic light-sensitive material having good graininess and sharpness and improved response to external pressure while maintaining high sensitivity.

The above objects of the present invention are achieved by:

(1) a silver halide color photographic light-sensitive material, wherein at least 50% of a total projected area of all silver halide grains in one emulsion layer containing silver halide grains reduction-sensitized by an ascorbic acid or at least one of the derivatives thereof are occupied by tabular silver halide grains having an average aspect ratio of not less than 3.0; and (2) a silver halide color photographic light-sensitive material, wherein at least 50% of a total projected surface area of all silver halide grains in one emulsion layer containing silver halide grains reduction-sensitized by an ascorbic acid or at least one of derivatives thereof in the presence of at least one of compounds represented by formulas (I), (II), and (III) are occupied by tabular silver halide grains having an average aspect ratio of not less than 3.0, $$R—SO_2S—M \quad (I)$$

$$R—SO_2S—R^1 \quad (II)$$

$$R—SO_2S—L_m—SSO_2—R^2 \quad (III)$$

The definitions of R, $R^1$, $R^2$, M and m in formulas (I), (II), and (III) are described below.

Accordingly, the above objects of the present invention are achieved by performing reduction sensitization by using at least one of ascorbic acid and its derivatives in a process of manufacturing a silver halide emulsion, and by a color light-sensitive material comprising a transparent support having thereon at least one light-sensitive silver halide emulsion layer, wherein 50 weight percent or more of silver halide grains contained in the emulsion layer are the silver halide grains constituting the silver halide emulsion manufactured by the above method.

More preferably, the above objects of the present invention are achieved by a method of manufacturing a silver halide emulsion in which reduction sensitization is performed by using at least one of ascorbic acid and its derivatives during precipitation of silver halide grains, a method of manufacturing a silver halide emulsion as in any one of the above methods, in which reduction sensitization is performed by using ascorbic acid or its derivative in an amount of $5\times10^{-5}$ to $1\times10^{-1}$ mol per mol of a silver halide, or a method of manufacturing a silver halide emulsion as in any one of the above methods, in which reduction sensitization is performed in the presence of at least one of compounds represented by formulas (I), (II), and (III).

$$R—SO_2S—M \quad (I)$$

$$R—SO_2S—R^1 \quad (II)$$

$$R—SO_2S—L_m—SSO_2—R^2 \quad (III)$$

wherein R, $R^1$, and $R^2$ can be the same or different and represent an aliphatic group, an aromatic group, or a heterocyclic group, M represents a cation, L represents a divalent bonding group, and m represents 0 or 1.

Compounds represented by formulas (I) to (III) can be polymers containing divalent groups derived from structures represented by formulas (I) to (III) as repeating units.

DETAILED DESCRIPTION OF THE INVENTION

The present invention will be described in detail below.

Processes of manufacturing silver halide emulsions are roughly classified into, e.g., grain formation, desalting, chemical sensitization, and coating steps. Grain formation is further classified into e.g. nucleation, ripening, and precipitation substeps. These steps are performed not in the above-mentioned order but in a reverse order or repeatedly. "To perform reduction sensitization in a process of manufacturing silver halide emulsions" means that reduction sensitization can be basically performed in any step. The reduction sensitization can be performed during nucleation or physical ripening in the initial stage of grain formation, during precipitation, or before or after chemical sensitization. In the case of performing chemical sensitization including gold sensitization, sulfer sensitization, selenium sensitization or a mixture thereof, the reduction sensitization is perferably performed before the chemical sensitization so as not to produce an undesired fog. The reduction sensitization is most preferably performed during precipitation of silver halide grains. The method of performing the reduction sensitization during precipitation includes a method of performing the reduction sensitization while silver halide grains are grown by physical ripening or addition of a water-soluble silver salt and a water-soluble alkali halide and a method of performing the reduction sensitization while grain precipitation is temporarily stopped and then precipitating grains Examples of ascorbic acid and its derivative (to be referred to as an "ascorbic acid compound" hereinafter) are as follows.

(A-1) L-ascorbic Acid
(A-2) Sodium L-ascorbate
(A-3) Potassium L-ascorbate
(A-4) DL-ascorbic Acid
(A-5) Sodium D-ascorbate
(A-6) L-ascorbic acid 6-acetate
(A-7) L-ascorbic acid 6-palmitate
(A-8) L-ascorbic acid 6-benzoate
(A-9) L-ascorbic acid 5,6-diacetate
(A-10) L-ascorbic acid 5,6-O-isopropylidene In order to add the above ascorbic acid compounds in a process of manufacturing a silver halide emulsion of the present invention, they can be dispersed directly in an emulsion, or can be dissolved in a solvent or solvent mixture of, e.g., water, methanol, and ethanol and then added in the manufacturing process.

It is desired that the ascorbic acid compound of the present invention is used in an amount much larger than a preferable addition amount of a conventional reduction sensitizer. For example, JP-B-57-33572 describes "an amount of a reducing agent normally does not exceed $0.75\times10^{-2}$ milli equivalent amount ($8\times10^{-4}$ mol/AgX mol) per gram of silver ions. An amount of 0.1 to 10 mg ($10^{-7}$ to $10^{-5}$ mol/AgX mol for ascorbic acid) per kg of silver nitrate is effective in many cases" (reduced values are calculated by the present inventors). U.S. Pat. No. 2,487,850 describes that "a tin compound can be used as a reduction sensitizer in an addition amount of $1\times10^{-7}$ to $44\times10^{-6}$ mol". JP-A-57-179835 describes that it is suitable to add about 0.01 mg to about 2 mg of thiourea dioxide or about 0.01 mg to about 3 mg of stannous chloride per mol of a silver halide. A preferable addition amount of the ascorbic acid compound used in the present invention depends on factors such as grain size and halogen composition of an emulsion, temperature, ph, and pAg in emulsion preparation. The addition amount, however, is selected from a range of, preferably, $5\times10^{-5}$ mol to $1\times10^{-1}$ mol, more preferably, $5\times10^{-4}$ mol to $1\times10^{-2}$ mol, and most preferably, $1\times10^{-3}$ mol to $1\times10^{-2}$ mol per mol of a silver halide.

Although the ascorbic acid compound of the present invention can be added at any timing in an emulsion manufacturing process, it is most preferably added during grain precipitation. The ascorbic acid compound is preferably added at an arbitrary timing in grain formation though it can be added in a reaction vessel beforehand. In addition, a reduction sensitizer can be added in an aqueous solution of a water-soluble silver salt or water-soluble alkali halide to perform grain formation by using this aqueous solution. A method of adding a solution of the reduction sensitizer several times or continuously adding it over a long time period during grain growth is also preferable.

Although a method of performing reduction sensitization by using the ascorbic acid compound of the present invention is superior to a conventional reduction sensitization method in sensitivity, fogging density, and age stability, it is sometimes more preferable to use the method of the present invention in combination with another reduction sensitization method. In this case, however, it is preferred that the other method is used as merely an auxiliary means of reduction sensitization and a main means of reduction sensitization is performed by the ascorbic acid compound. A method to be used in combination with the method of the present invention can be selected from a method of adding a known reducing agent to a silver halide emulsion, a method called silver ripening in which precipitating or ripening is performed in a low-pAg atmosphere of a pAg of 1 to 7, and a method called high pH ripening in which precipitating or ripening is performed in a high-pH atmosphere of a pH of 8 to 11.

A method of adding a reduction sensitizer is preferable because the level of reduction sensitization can be precisely adjusted.

As the reduction sensitizer, for example, stannous salt, amines and polyamines, a hydrazine derivative, formamidinesulfinic acid, a silane compound, and a borane compound are known. The ascorbic acid compound, however, can provide superior results to those obtained by the above known reduction sensitizers.

In the present invention, it is preferred to perform reduction sensitization by using the ascorbic acid compound in a process of manufacturing a silver halide emulsion and to add at least one compound selected from compounds represented by formulas (I), (II), and (III) during the manufacturing process.

$$R—SO_2S—M \quad (I)$$

$$R—SO_2S—R^1 \quad (II)$$

$$RSO_2S—L_m—SSO_2—R^2 \quad (III)$$

wherein R, $R^1$, and $R^2$ can be the same or different and represent an aliphatic group, an aromatic group, or a heterocyclic group, M represents a cation, L represents a divalent bonding group, m represents 0 or 1.

Thiosulfonic acid compounds represented by formulas (I), (II), and (III) will be described in more detail below. When R, $R^1$ and $R^2$ each represent an aliphatic group, it is a saturated or unsaturated, straight-chain, branched or cyclic aliphatic hydrocarbon group and is preferably alkyl having 1 to 22 carbon atoms or alkenyl or alkinyl having 2 to 22 carbon atoms. These groups can have a substituent group. Examples of the alkyl are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl are allyl and butenyl.

Examples of the alkinyl are propargyl and butynyl.

An aromatic group of R, $R^1$, and $R^2$ includes aromatic group of single-ring or condensed-ring and preferably has 6 to 20 carbon atoms. Examples of such an aromatic group are phenyl and naphthyl. These groups can have substituent group.

A heterocyclic group of R, $R^1$, and $R^2$ includes a 3- to 15-membered ring having at least one element of nitrogen, oxygen, sulfur, selenium, and tellurium and at least one carbon atom, preferably, a 3 to 6-membered ring. Examples of the heterocyclic group are pyrrolidine, piperidine, pyridine, tetrahydrofurane, thiophene, oxazole, thiazole,, imidazole, benzothiazole, benzoxazole, benzimidazole, selenazole, benzoselenazole, tellurazole, triazole, benzotriazole, tetrazole oxadiazole, and thiadiazole.

Examples of the substituent group on R, $R^1$, and $R^2$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g. phenoxy), an alkylthio group (e.g., methylthio and butylthio), an arylthio group (e.g. phenylthio), an acyl group (e.g. acetyl, propionyl, butyryl, and valeryl), a sulfonyl group (e.g. methyl sulfonyl and phenylsulfonyl), an acylamino group (e.g., acetylamino and benzaoylamino), a sulfonylamino group (e.g., methanesulfonylamino and benzenesulfonylamino), an acyloxy group (e.g., acetoxy and benzoxy), carboxyl, cyano, sulfo, amino, $—SO_2SM$ (M represent a monovalent cation), and $—SO_2R^1$.

A divalent bonding group represented by L includes an atom or an atom group containing at least one of C, N, S, and O. Examples of L are alkylene, alkenylene, alkynylene, arylene, —O—, —S—, —NH—, —CO—, and $—SO_2—$. These divalent groups can be used singly or in a combination of two or more thereof.

Preferably L represents a divalent aliphatic group or a divalent aromatic group. Examples of the divalent aliphatic of L are $-(CH_2)_n-$ (n=1 to 12), $—CH_2—CH=CH—CH_2—$, $—CH_2C\equiv CCH_2—$,

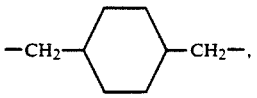

and xylylene. Examples of the divalent aromatic group of L are phenylene and naphthylene.

These substituent groups can have further substituent group above-mentioned.

M is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g. tetraphenylphosphonium), and a guanidil group.

When a compound represented by each of formulas (I) to (III) is a polymer, examples of its repeating unit are as follows:

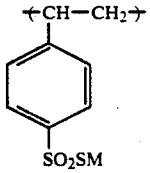

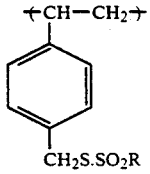

-continued

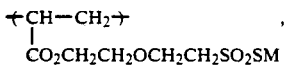

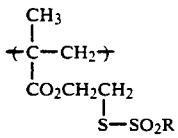

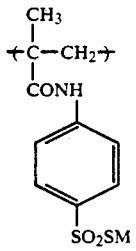

Each of the above polymers can be a homopolymer or a copolymer with another copolymerizable monomer.

Examples of a compound represented by formula (I), (II), or (III) are listed in Table A to be presented later. However, compounds are not limited to those in Table A.

A compound represented by formula (I), (II), or (III) is preferably added in an amount of $10^{-7}$ to $10^{-1}$ mol per mol of a silver halide. The addition amount is more preferably $10^{-6}$ to $10^{-2}$ mol/molAg and most preferably $10^{-5}$ to $10^{-3}$ mol/molAg.

A conventional method of adding an additive in a photographic emulsion can be adopted to add compounds represented by formulas (I) to (III) in a manufacturing process. For example, a water-soluble compound can be added in the form of an aqueous solution having an arbitrary concentration, and a water-insoluble or water-retardant compound is dissolved in an arbitrary organic solvent such as alcohols, glycols, ketones, esters, and amides, which is miscible with water and does not adversely affect photographic properties, and then added as a solution.

A compound represented by formula (I), (II), or (III) can be added at any timing in a manufacturing process, e.g., during grain formation of a silver halide emulsion or before or after chemical sensitization. The compound is preferably added before or during reduction sensitization. The compound is most preferably added during grain precipitation.

Although the compound can be added in a reaction vessel beforehand, it is preferably added at an arbitrary timing during grain formation. In addition, a compound represented by formula (I), (II), or (III) can be added in an aqueous solution of a water-soluble silver salt or water-soluble alkali halide to perform grain formation by using the aqueous solution. A method of adding a solution of a compound represented by formula (I), (II), or (III) several times or continuously adding it over a long time period during grain formation is also preferable.

A compound most preferable in the present invention is represented by formula (I).

A silver halide of any of silver bromide, silver iodobromide, silver iodochlorobromide, silver chlorobromide, and silver chloride can be used in a photographic emulsion layer of a photographic light-sensitive material used in the present invention. A preferable silver halide is silver iodobromide, silver bromide, or silver chlorobromide containing 30 mol% or less of silver iodide.

A silver halide grain to be used in the present invention can be selected from a regular crystal not including a twined crystal face and those describe in Japan Photographic Society ed., "Silver Salt Photographs, Basis of Photographic Industries", (Corona Co., P. 163) such as a single twined crystal including one twined crystal face, a parallel multiple twined crystal including two or more parallel twined crystal faces, and a non-parallel multiple twined crystal including two or more non-parallel twined crystal faces, in accordance with its application. In the case of a regular crystal, a cubic grain consisting of (100) faces, an octahedral grain consisting of (111) faces, and a dodecahedral grain consisting of (110) faces disclosed in JP-B-55-42737 and JP-A-60-222842 can be used. In addition, a grain having (hll), e.g., (211) faces, a grain having (hhl), e.g., (331) faces, a grain having (hk0), e.g., (210) faces, and a grain consisting of (hkl), e.g., (321) faces as reported in "Journal of Imaging Science", Vol. 30, P. 247, 1986 can be selectively used in accordance with an application although a preparation method must be improved. A grain including two or more types of faces, e.g., a tetradecahedral grain having both (100) and (111) faces, a grain having both (100) and (110) faces, and a grain having both (111) and (110) faces can be selectively used in accordance with an application.

The grain of a silver halide can be a fine grain having a grain size of 0.1 microns or less or a large grain having a projected surface area diameter of 10 microns. An emulsion can be a monodisperse emulsion having a narrow distribution or a polydisperse emulsion having a wide distribution.

A so-called monodisperse silver halide emulsion having a narrow size distribution, i.e., in which 80% or more (the number or weight of grains) of all grains fall within the range of ±30% of an average grain size. In order to satisfy target gradation of a light-sensitive material, two or more types of monodisperse silver halide emulsions having different grain sizes can be coated in a single layer or overlapped in different layers in emulsion layers having substantially the same color sensitivity. Alternatively, two or more types of polydisperse silver halide emulsions or a combination of monodisperse and polydisperse emulsions can be mixed or overlapped.

The photographic emulsions for use in the present invention can be prepared by using methods described in, for example, P. Glafkides, "Chimie et Physique Photographique", Paul Montel, 1967; Duffin, "Photographic Emulsion Chemistry", Focal Press, 1966; and V.L. Zelikman et al., "Making and Coating Photographic Emulsion", Focal Press, 1964. That is, the photographic emulsion can be prepared by, e.g., an acid method, a neutralization method, and an ammonia method. Also, as a system for reacting a soluble silver salt and a soluble halide, a single mixing method, a double mixing method, or a combination thereof can be used. Also, a so-called back mixing method for forming silver halide grains in the presence of excessive silver ions can be used. As one system of the double mixing method, a so-called controlled double jet method wherein the pAg in the liquid phase, where the silver halide is generated, kept at a constant value can be used.

According to this method, a silver halide emulsion having a regular crystal form and almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, 159-165 (1962); "Journal of Photographic Science", Vol. 12, 242-251 (1964); U.S. Pat. No. 3,655,394, and British Patent 1,413,748.

A tabular grain having an aspect ratio of 3 or more can also be used in the present invention. The tabular grain can be easily prepared by methods described in, for example, Cleve, "Photography Theory and Practice", (1930), P. 131; Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and a color sensitizing efficiency of a sensitizing dye can be advantageously improved as described in detail in U.S. Pat. No. 4,434,226.

The tabular grains are preferably used in the emulsion of the present invention. In particular, tabular grains in which grains having aspect ratios of 3 to 8 occupy 50% or more of a total projected surface area are preferable.

A crystal structure can be uniform, can have different halogen compositions inside and outside a crystal, or can be layered structure. These emulsion grains are disclosed in, e.g., British Patent 1,027,146, U.S. Pat. Nos. 3,505,068 and 4,444,877, and Japanese Patent Application No. 58-248469. In addition, a silver halide having different compositions can be bonded by an epitaxial junction, or a compound other than a silver halide such as silver rhodanate or zinc oxide can be bonded.

In the present invention, a tabular grain means a grain having a plurality of parallel twinned crystal faces and a tabular shape regardless of its aspect ratio. A grain having no twinned crystal face and having an aspect ratio of 2 or more is also included in the tabular grain. The latter grain includes a rectangular parallelepiped grain as reported in A. Mignot et al., "Journal of Cryst. Growth", Vol. 23, P. 207 (1974).

In a tabular silver halide emulsion reduction-sensitized by an ascorbic acid compound, an aspect ratio means a ratio of a diameter of a silver halide grain with respect to its thickness. That is, the aspect ratio is a value obtained by dividing the diameter of each silver halide grain by its thickness. In this case, the diameter means a diameter of a circle having an area equal to a projected area of a grain upon observation of a silver halide emulsion by a microscope or electron microscope. Therefore, when the aspect ratio is 3 or more, the diameter of a circe is three times or more the thickness of a grain.

An average aspect ratio is obtained as follows. That is, 1,000 silver halide grains of the emulsion are extracted at random to measure their aspect ratios, tabular grains corresponding to 50% of a total projected area are selected from those having larger aspect ratios, and a number-average of aspect ratios of the selected tabular grains is calculated. A number-average of a diameter or thickness of the tabular grains used to calculate the average aspect ratio is defined as an average grain size or average grain thickness, respectively.

An example of an aspect ratio measuring method is a method of photographing a transmission electron micrograph by a replica technique to obtain a circle-equivalent diameter and a thickness of each grain. In this case, the thickness is calculated from the length of a shadow of the replica.

The average aspect ratio of the tabular silver halide grains reduction-sensitized by the ascorbic acid compound is 3.0 or more, preferably, 3 to 20, more preferably, 4 to 15, and most preferably, 5 to 10. In one emulsion layer, a ratio of a projected area occupied by tabular silver halide grains with respect to all silver halide grains is 50% or more, preferably, 70% or more, and more preferably, 85% or more.

A silver halide photographic light-sensitive material having good sharpness can be obtained by using such an emulsion. The sharpness is good because a degree of light scattering caused by an emulsion layer using the above emulsion is much smaller than that of a conventional emulsion layer. This can be easily confirmed by an experiment method ordinarily used by those skilled in the art. The reason why the light scattering degree of an emulsion layer using the tabular silver halide emulsion is small is not clear. It can be assumed, however, that a major surface of the tabular silver halide emulsion grain is oriented parallel to the surface of a support.

The average grain diameter of the tabular silver halide grains reduction-sensitized by the ascorbic acid compound is 0.2 to 10.0 μm, preferably, 0.3 to 5.0 μm, and more preferably, 0.4 to 3.0 μm. The average grain thickness is preferably 0.5 μm or less. In a more preferable silver halide photographic emulsion, the average grain size is 0.4 to 3.0 μm, the average grain thickness is 0.5 μm or less, the aspect aspect ratio is 5 to 10, and 80% or more of a total projected area of all silver halide grains are occupied by tabular grains.

The tabular silver halide grains reduction-sensitized by the ascorbic acid compound may be any of silver chloride, silver bromide, silver chlorobromide, silver iodobromide, and silver chloroiodobromide. More preferable examples are silver bromide, silver iodobromide having 20 mol % or less of silver iodide, and silver chloroiodobromide and silver chlorobromide having 50 mol % or less of silver chloride and 2 mol % or less of silver iodide. In a mixed silver halide, a composition distribution may be uniform or localized.

The tabular silver halide emulsion of the present invention can be prepared by, for example, forming a seed crystal having 40% (weight) or more of tabular grains in a comparatively-high-pAg atmosphere in which a pBr is 1.3 or less, and simultaneously adding silver and halogen solutions to grow the seed crystal while the pBr Value is maintained substantially the same level. In this grain growth step, it is preferred to add the silver and halogen solutions so that no new crystal nucleus is generated.

In a tabular silver halide emulsion reduction-sensitized by the ascorbic acid compound, the size of emulsion grains can be adjusted, for example, by adjusting a temperature, selecting the type or quality of a solvent, and controlling addition rates of silver salts and halides used in grain formation.

The silver halide emulsion of the present invention preferably has a distribution or structure of a halogen composition in its grain. A typical example is a core-shell type or double structured grain having different halogen compositions in the interior and surface layer of the grain as disclosed in, e.g., JP-B-43-13162, JP-A-

61-215540, JP-A-60-222845, and JP-A-61-75337. In such a grain, the shape of a core portion is sometimes identical to or sometimes different from that of the entire grain with a shell. More specifically, while the core portion is cubic, the grain with a shell is sometimes cubic or sometimes octahedral. On the contrary, while the core portion is octahedral, the grain with a shell is sometimes cubic or sometimes octahedral. In addition, while the core portion is a clear regular grain, the grain with a shell is sometimes slightly deformed or sometimes does not have any definite shape. Furthermore, not a simple double structure but a triple structure as disclosed in JP-A-60-222844 or a multilayered structure of more layers can be formed, or a thin layer of a silver halide having a different composition can be formed on the surface of a core-shell double structure grain.

In order to give a structure inside the grain, a grain having not only the above surrounding structure but a so-called junction structure can be made. Examples of such a grain are disclosed in, e.g., JP-A-59-133540, JP-A-58-108526, EP 199290A2, JP-B-58-24772, and JP-A-59-16254. A crystal bonded having a composition different from that of a host crystal can be produced and bonded to an edge, corner, or face portion of the host crystal. Such a junction crystal can be formed regardless of whether the host crystal has a homogeneous halogen composition or a core-shell structure.

The junction structure can be naturally made by a combination of silver halides. In addition, the junction structure can be made by combining a silver salt compound not having a rock salt structure, e.g., silver rhodanate or silver carbonate, with a silver halide. A non-silver salt compound such as PbO can also be used as long as the junction structure can be made.

In a silver iodobromide grain having the above structure, e.g., in a core-shell type grain, the silver iodide content can be high at a core portion and low at a shell portion or vice versa. Similarly, in a grain having the junction structure, the silver iodide content can be high in a host crystal and relatively low in a junction crystal or vice versa.

In a grain having the above structure, a boundary portion between different halogen compositions can be clear or unclear due to a crystal mixture formed by a composition difference. Alternatively, a continuous structure change can be positively made.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

The silver halide emulsion for use in the present invention is preferably of a surface latent image type. An internal latent image type emulsion, however, can be used by selecting a developing solution or development conditions as disclosed in JP-A-59-133542. In addition, a shallow internal latent image type emulsion covered with a thin shell can be used in accordance with an application.

A solvent for silver halide can be effectively used to promote ripening. For example, in a known conventional method, an excessive amount of halogen ions are supplied in a reaction vessel in order to promote ripening. Therefore, it is apparent that ripening can be promoted by only supplying a silver halide solution into a reaction vessel. In addition, another ripening agent can be used. A total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added singly in step of adding a halide and a silver salt.

Examples of the ripening agent other than the halogen ion are ammonia, an amine compound and a thiocyanate such as an alkali metal thiocyanate, especially sodium or potassium thiocyanate and ammonium thiocyanate.

In the present invention, it is very important to perform chemical sensitization represented by sulfur sensitization and gold sensitization because significant effects can be obtained upon chemical sensitization. A portion to be subjected to the chemical sensitization differs in accordance with the composition, structure, or shape of an emulsion grain or an application of the emulsion. That is, a chemical sensitization nucleus is embedded either inside a grain or in a shallow portion from the grain surface or formed on the surface of a grain. Although the present invention is effective in any case, the chemical sensitization nucleus is most preferably formed in a portion near the surface. That is, the present invention is more effective in the surface latent image type emulsion than in the internal latent image type emulsion.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8 and a temperature of 30 to 80° C by using sulfur, selenium, tellurium, gold, platinum, palladium or irridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization assistant. An example of the chemical assistant is a compound known to suppress fogging and increase sensitivity in the chemical sensitization process such as azaindene, azapyridazine, and azapyrimidine. Examples of a chemical sensitization assistant modifier are described in U.S. Pat. Nos. 2,131,038, 3,411,914, 3,554,757, JP-A-58-126526 and G. F. Duffin, "Photographic Emulsion Chemistry", PP. 138 to 143.

The photographic emulsion for use in the present invention can contain various compounds in order to prevent fogging during manufacture, storage, or a photographic treatment of the light-sensitive marerial or to stabilize photographic properties. Examples of the compound known as an antifoggant or stabilizer are azoles, e.g., benzothiazolium salts, nitro imidazoles, nitrobenzimidazoles, chlorobenzimidazoles, bromobenzimidazoles, mercaptothiazoles, mercaptobenzothiazoles, mercaptobenzimidazoles, mercaptothiaziazoles, aminotriazoles, benzotriazoles, nitrobenzotriazoles, and mercaptotetrazoles (especially, 1-phenyl-5-mercaptotetrazole); mercaptopyrimidines; mercaptotriadines; a thioketo compound such as oxadrinthione; azaindenes, e.g., triazaindenes, tetraazaindenes (especially, 4-hydroxy-substituted (1,3,3a,7)tetraazaindenes), and pentaazaindenes. Examples are described in U.S. Pat. Nos. 3,954,474 and 3,982,947 and JP-B-52-28660.

The photographic emulsion for use in the present invention can be spectrally sensitized with, for example, methine dyes. Examples of the dye to be used are a cyanine dye, merocyanine dye, a composite cyanine dye, a composite merocyanine dye, a holopolar cyanine dye, a hemicyanine dye, a styryl dye, and hemioxonol dye. Most effective dyes are those belonging to a cyanine dye, a merocyanine dye, and a composite merocyanine dye. In these dyes, any nucleus normally used as a basic heterocyclic nucleus in cyanine dyes can be used. Examples of the nucleus are pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus obtained by condensing an alicyclic hydrocarbon ring to each of the above nuclei; and a nucleus obtained by condensing an aromatic hydrocarbon ring to each of the above nuclei, e.g., an indolenine nucleus, a benzindolenine nucleus, an indole nucleus, a benzoxadole nucleus, a naphthooxazole nucleus, a benzothiazole nucleus, a naphthothiazole nucleus, a benzoselenazole nucleus, a benzimidazole nucleus, and a quinoline nucleus. These nucei can have a substituent group on a carbon atom.

For a merocyanine dye or composite merocyanine dye, a 5- or 6-membered heterocyclic nucleus, e.g., a pyrazoline-5-one nucleus, a thiohydantoin nucleus, a 2-thioxazolidine-2,4-dione nucleus, a thiazolidine-2,4-dione nucleus, a rhodanine nucleus, and a thiobarbituric acid nucleus can be used as a nucleus having a ketomethylene structure.

These sensitizing dyes can be used singly or in a combination of two or more thereof. A combination of the sensitizing dyes is often used especially in order to perform supersensitization. Typical examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281 and 1,507,803, JP-B-43-4936 and JP-B-53-12375, and JP-A-52-110618 and JP-A-52-109925.

The emulsion can contain, in addition to the sensitizing dye, a dye not having a spectral sensitizing effect or a substance substantially not absorbing visible light, having supersensitization.

The dye can be added in the emulsion at any time conventionally known to be effective in emulsion preparation. Most ordinarily, the dye is added after completion of chemical sensitization and before coating. However, the dye can be added at the same time as a chemical sensitizer to simultaneously perform spectral sensitization and chemical sensitization as described in U.S. Pat. Nos. 3,628,969 and 4,225,666, added before chemical sensitization as described in JP-A-58-113928, or added before completion of silver halide grain precipitation to start spectral sensitization. In addition, as described in U.S. Pat. No. 4,225,666, the above compound can be separately added such that a portion of the compound is added before chemical sensitization and the remaining portion is added thereafter. That is, as described in U.S. Pat. No. 4,183,756, the compound can be added at any time during silver halide grain formation.

An addition amount can be $4\times10^{-6}$ to $8\times10^{-3}$ mol per mol of silver halide. More preferably, when a silver halide grain size is a preferable size i.e. 0.1 to 1.2 μm, an addition amount of about $5\times10^{-5}$ to $2\times10^{-3}$ mol is more effective.

The above various additives can be used in the light-sensitive material of the present invention. In addition to the above additives, however, various additives can be used in accordance with desired application.

These additives are described in Research Disclosures, Item 17643 (Dec. 1978) and Item 18716 (Nov. 1979) and they are summarized in the following table.

| | Additives | RD No. 17643 | RD No. 18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | |
| 5. | Antifoggants and stabilizers | pages 24–25<br>pages 24–25 | page 649, right column |
| 6. | Light absorbent, filter dye, ultraviolet absorbents | pages 25–26 | page 649, right column to page 650, left column |
| 7. | Stain preventing agents | page 25, right column | page 650, left to right columns |
| 8. | Dye image stabilizer | page 25 | |
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |

In this invention, various color couplers can be used. Specific examples of these couplers are described in above-described Research Disclosure, No. 17643, VII-C to VII-G as patent references.

Preferred examples of a yellow coupler are described in, for example, U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, for example, U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-34659, and U.S. Pat. Nos. 4,500,630 and 4,540,654.

Examples of a cyan coupler ar phenol and naphthol couplers, and preferably, those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S.

Pat. Nos. 4,004,929 and 4,138,258, and British Patent 1,146,368.

Preferable examples of a coupler capable of forming colored dyes having proper diffusibility ar those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound releasing couplers, described in, e.g., JP-A-60-185950 and JP-A-62-24252; couplers releasing a dye which turns to a colored form after being released described in EP 173,302A; bleaching accelerator releasing couplers described in, e.g., R.D. Nos. 11449 and 24241 and JP-A-61-201247; and a legand releasing coupler described in, e.g., U.S. Pat. No. 4,553,477.

The couplers for use in this invention can be introduced in the light-sensitive materials by various known dispersion methods.

Examples of a high-boiling solvent used in an oil-in-water dispersion method are described in, for example, U.S. Pat. No. 2,322,027.

Examples of a high-boiling organic solvent to be used in the oil-in-water dispersion method and having a boiling point of 175° C or more at normal pressure are phthalic esters (e.g., dibutylphthalate, dicyclohexylphthalate, and di-2-ethylhexylphthalate), phophates or phosphonates (e.g., triphenyl phosphate, tricresylphosphate, 2-ethylhexyldiphenylphosphate, tricyclohexylphosphate, and tri-2-ethylhexylphosphate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an loadable latex are described in, e.g., U.S. Pat. No. 4,199,363 and West German Patent Application (OLS) Nos. 2,541,274 and 2,541,230.

The present invention can be applied to various color light-sensitive materials. Examples of the material are a color negative film for a general purpose or a movie, a color reversal film for a slide or a television, color paper, a color positive film, and color reversal paper.

Preferably, in a color light-sensitive material comprising a transparent support having thereon at least one light sensitive silver halide emulsion layer, 50 weight percent or more of silver halide grains contained in said emulsion layer are the silver halide grains constituting the silver halide emulsion manufactured by the method of manufacturing a silver halide emulsion, wherein reduction sensitization is performed by using at least one of ascorbic acid and derivatives thereof in a process of manufacturing a silver halide emulsion.

When the present invention is used as a material for color photography, the present invention can be applied to light-sensitive materials having various structures and to light-sensitive materials having combinations of layer structures and special color materials.

Typical examples are: light-sensitive materials in which a coupling speed of a color coupler or diffusibility is combined with a layer structure, as disclosed in, e.g., JP-B-47-49031, JP-B-49-3843, JP-B-50-21248, JP-A-59-38147, JP-A-59-60437, JP-A-60-227256, JP-A-61-4043, JP-A-61-43743, and JP-A-61-42657; light-sensitive materials in which a single color-sensitive layer is divided into two or more layers, as disclosed in JP-B-49-15495 and U.S. Pat. No. 3,843,469; and light-sensitive materials, in which an arrangement of high- and low-sensitivity layers or layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described in the above-mentioned RD. No. 17643, page 28 and ibid., No. 18716, page 647, right column to page 648, left column.

The color photographic light-sensitive materials of this invention can be processed by ordinary processes as described, for example, in the above-described Research Disclosure, No. 17643, pages 28 to 29 and ibid., No. 18716, page 651, left to right columns.

A color developer used in developing of the light-sensitive material of the present invention is, preferably, an aqueous alkaline solution containing as a main component an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino N,N-diethylaniline, 3-methyl-4-amino-N-ethyl-N-β-hydroxyethylaniline, 3-methyl-4-amino-N-ethyl-N-β-methanesulfonamidoethylanline, 3-methyl-4-amino-N-ethyl-N-β-methoxyehtylaniline, and sulfates, hydrochlorides and p-toluenesulfonates thereof. These compounds can be used in a combination of two or more thereof in accordance with the desired application.

In general, the color developer contains a pH buffering agent such as a carbonate, a borate or a phosphate of an alkali metal, and a development restrainer or an antifoggant such as a bromide, an iodide, a benzimidazole, a benzothiazole or a mercapto compound. If necessary, the color developer can also contain a preservative such as hydroxylamine, diethylhy droxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color developer and black-and-white developer is generally 9 to 12. Although a replenishment amount of the developer depends on a color photographic light-sensitive material to be processed, it is generally 3 liters or less per $m^2$, of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air. The replenishment amount can be decreased by using a means capable of suppressing an accumulation amount of bromide ions in the developer.

The color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching can be performed either simultaneousy with fixing (bleach-fixing) or independently thereof. In addition, in order to increase the processing speed, bleach-fixing can be performed after bleaching. Also, processing can be performed in a bleach-fixing bath having two continuous tanks, fixing can be performed before bleach-fixing, or bleaching can be performed after bleach-fixing, in accordance with the desired application. Examples of the bleaching agent are a compound of a multivalent metal such as iron (III), cobalt (III), chromium (VI) and copper (II); a peroxide., a quinone; and a nitro compound. Typical examples of the bleaching agent are a ferricyanide; a dichromate; an organic complex salt of iron (III) or cobalt (III), e.g., a complex salt of an aminopolycarboxylic acid such as ethylened; aminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate., a bromate; a permanganate; and a nitrobenzene. Of these compounds, an iron (III) complex salt of aminopolycarboxylic acid such as an iron (III) complex salt of ethylenediaminetetraacetic acid, and a persulfate are preferred because they can increase the processing speed and prevent an environmental contamination. The iron (III) complex salt of aminopolycarboxylic acid is effective in both the bleaching solution and bleach-fixing solution. The pH of the bleaching or bleach-fixing solution using the iron (III) complex salt of aminopolycarboxylic acid is normaly 5.5 to 8. In order to increase the processing speed, however, processing can be performed at a lower pH.

A bleaching accelerator can be used in the bleaching solution, the bleach-fixing solution and their prebath, if necessary. Effective examples of the bleaching accelerator are described in, for example, U.S. Pat. No. 3,893,858. A compound described in U.S. Pat. No. 4,552,834 is also preferable. These bleaching accelerators can be added in the light-sensitive material. These bleaching accelerators are effective especially in bleach-fixing of a photographic color light-sensitive material.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The photographic light-sensitive material of the present invention is normally subjected to washing and/or stabilizing steps after desilvering. An amount of water used in the washing step can be arbitrarily determined over a broad range in accordance with the properties (e.g., a property determined by used material such as a coupler) of the light-sensitive material, the application of the photographic material, the temperature of the washing water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248-253 (May, 1955).

According to the above-described multi-stage counter-current scheme, the amount of water used for washing can be greatly decreased. Since washing water stays in the tanks for a long period of time, however, bacteria multiply and floating substances can be undesirably attached to the light-sensitive material. In order to solve this problem in the process of the color photographic light-sensitive material of the present invention, a method of decreasing calcium and magnesium ions can be quite effectively utilized, as described in JP-A-61-131632. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Cyclopedia of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing formation and a surface-active agnet to be used as a final bath of the photographic color light-sensitive material. Various chelating agents or antifungal agents can be added also in the stabilizing bath.

An overflow solution produced upon washing and/or replenishment of the stabilizing solution can be reused in another step such as a desilvering step.

The silver halide color light-sensitive material of the present invention can contain a color developing agent in order to simplify processing and increase the processing speed.

The silver halide color light-sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although the normal processing temperature is 33° C. to 38° C., processing can be accelerated at a high temperature to shorten the processing time, or image quality or stability of a processing solution can be improved at a lower temperature. In order to save silver for the light-sensitive material, processing using cobalt intensification or hydrogen peroxide intensification described in West German Patent No. 3,226,770 or U.S. Pat. No. 3,674,499 can be performed.

The silver halide light-sensitive material of the present invention can also be applied to thermal development light-sensitive materials described in, e.g., U.S. Pat. No. 4,500,626, JP-A-60-133449, JP-A-59-218443, JP-A-61-238056, and EP 210,660A2.

The present invention will be described in more detail below by way of its examples.

EXAMPLE 1

Double twined crystal grains comprising silver iodobromide and having an average iodide content of 24 mol % and an average sphere-equivalent diameter of 0.8 μm were used as seed crystals to form an emulsion in an aqueous gelatin solution by a controlled double jet method, the emulsion comprising twined crystal grains comprising silver iodobromide and having an average sphere-equivalent diameter of 1.2 μm, in which a core/shell ratio was 1:2, a shell iodide content was 2 mol %, and an average iodide content was 10 mol %.

After grain formation, the emulsion was subjected to a normal desalting/washing step and redispersed under conditions of 40° C., a pAg of 8.9, and a pH of 6.3, thereby preparing an emulsion Em-1. Thiosulfonic acid compounds 1-2, 1-6, and 1-16 listed in Table A were individually added in a reaction vessel in addition amounts listed in Table 1-1, one minute before shell formation was started, to perform grain formation, thereby preparing emulsions Em-2 to Em-4.

TABLE 1-1

| Emulsion | Thiosulfonic Acid Compound | Addition Amount per Mol of Ag |
|---|---|---|
| Em-2 | 1-2 | $3 \times 10^{-5}$ mol |
| Em-3 | 1-6 | $3 \times 10^{-5}$ mol |
| Em-4 | 1-16 | $3 \times 10^{-5}$ mol |

When grain formation was performed following the same procedures as for Em-1, the reduction sensitizer A-1 (L-ascorbic acid) and tin chloride were added in addition amounts listed in Table 1-2 one minute after shell formation was started, thereby preparing emulsions Em-5 and Em-6.

TABLE 1-2

| Emulsion | Reduction Sensitizer | Addition Amount per Mol of Ag |
|---|---|---|
| Em-5 | L-ascorbic Acid | $2 \times 10^{-3}$ mol |
| Em-6 | Tin Chloride (II) | $1 \times 10^{-5}$ mol |

When grain formation was performed following the same procedures as for Em-1, the thiosulfonic acid compounds 1-2, 1-6, and 1-16 were added one minute before shell formation was started, and optimal amounts of the reduction sensitizer L-ascrobic acid and tin chloride were added one minute after shell formation was started, thereby preparing emulsions Em-7 to Em-12 of the present invention and comparative examples listed in Table 1-3.

TABLE 1-3

| Emulsion | Reduction Sensitizer | Addition Amount per Mol of Ag | Thiosulfonic Acid Compound | Addition Amount per Mol of Ag |
|---|---|---|---|---|
| Em-7 | L-ascorbic Acid | $2 \times 10^{-3}$ mol | 1-2 | $3 \times 10^{-5}$ mol |
| 8 | " | " | 1-6 | " |
| 9 | " | " | 1-16 | " |
| 10 | Tin Chloride | $1 \times 10^{-5}$ mol | 1-2 | " |
| 11 | " | " | 1-6 | " |
| 12 | " | " | 1-16 | " |

The emulsions Em-1 to Em-12 of the present invention and comparative examples prepared as described above were subjected to optimal gold-plus-sulfur-sensitization by using sodium thiosulfate and chloroauric acid, thereby preparing emulsions.

Emulsion and protective layers in amounts as listed in Table 1-4 were coated on triacetylcellulose film supports having undercoating layers.

TABLE 1-4

(1) Emulsion Layer

Emulsion . . . emulsions 1 to 12 shown in Table 1-1 to 1-3 (silver $1.7 \times 10^{-2}$ mol/m$^2$)

Coupler ($1.5 \times 10^{-3}$ mol/m$^2$)

TABLE 1-4-continued

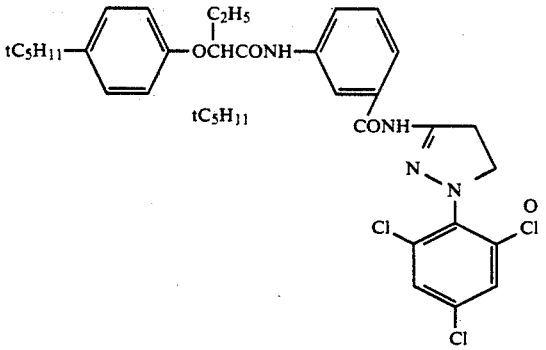

| | | |
|---|---|---|
| | Tricresylphosphate | (1.10 g/m$^2$) |
| | Gelatin | (2.30 g/m$^2$) |
| (2) | Protective Layer | |
| | 2,4-dichlorotriazine-6-hydroxy-s-triazine sodium salt | (0.08 g/m$^2$) |
| | Gelatin | (1.80 g/m$^2$) |

These samples were subjected to sensitometry exposure, thereby performing the following color development.

The processed samples were subjected to density measurement by using a green filter. The results of obtained photographic properties are listed in Table 1-5.

Development was performed under the following conditions at a temperature of 38° C.

| | | |
|---|---|---|
| 1. | Color Development | 2 min. 45 sec. |
| 2. | Bleaching | 6 min. 30 sec. |
| 3. | Washing | 3 min. 15 sec. |
| 4. | Fixing | 6 min. 30 sec. |
| 5. | Washing | 3 min. 15 sec. |
| 6. | Stabilizing | 3 min. 15 sec. |

The compositions of the processing solutions used in the above steps were as follows.

| | |
|---|---|
| Color Developer: | |
| Sodium Nitrilotriacetic Acid | 1.4 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Sodium Bromide | 160.0 g |
| Ammonia Water (28%) | 25.0 ml |
| Iron (III) Sodium Ethylenediaminetetra-acetate trihydrate | 130 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (700 g/l) | 175.0 ml |
| Sodium Bisulfite | 4.6 g |
| Water to make | 1 l |
| Stabilizing Solution: | |
| Formalin | 8.0 ml |
| Water to make | 1 l |

In this case, a normal wedge exposure was performed for ten seconds and 1/100 seconds.

A light source was adjusted at a color temperature of 4,800° K. by using a filter, and blue light was extracted by using a blue filter (BPN42 (tradename): available from Fuji Photo Film Co. Ltd.). Sensitivities were compared at a point from a fogging density by an optical density of 0.2. The sensitivities are listed as relative sensitivities assuming that the sensitivity of a sample using the emulsion Em-1 is 100 (100 for both 1/100" and 10"). Each fogging density was a value with respect to a non-exposed portion and the same for both 1/100" and 10").

As is apparent from Table 1-5, each emulsion of the present invention had low fogging density and high sensitivity (especially with low intensity).

After samples 1 to 12 coated with the emulsions 1 to 12 were aged in the environment wherein temperature was 25° C. and the humidity was 60% for 12 months, the sensitometry test was performed following the same procedures as described above. The results represented by relative sensitivities assuming that the sensitivity of the sample 1 before aging was 100 are listed in Table 1-6. According to each sample coated with the emulsion of the present invention, both a decrease in sensitivity and an increase in fogging density were small after aging, thereby realizing good storage stability.

TABLE 1-5

| Sample | 1/100" Sensitivity | 10" Sensitivity | Fogging Density | Remarks |
|---|---|---|---|---|
| 1 | 100 | 100 | 0.20 | Comparative Example |
| 2 | 83 | 78 | 0.18 | Comparative Example |
| 3 | 81 | 75 | 0.19 | Comparative Example |
| 4 | 75 | 70 | 0.18 | Comparative Example |
| 5 | 121 | 130 | 0.19 | Present Invention |
| 6 | 100 | 104 | 0.29 | Comparative Example |
| 7 | 130 | 140 | 0.19 | Present Invention |
| 8 | 128 | 135 | 0.18 | Present Invention |
| 9 | 126 | 133 | 0.18 | Present Invention |
| 10 | 120 | 126 | 0.23 | Comparative Example |
| 11 | 120 | 126 | 0.22 | Comparative Example |
| 12 | 115 | 120 | 0.26 | Comparative Example |

TABLE 1-6

| Sample | 1/100" Sensitivity | 10" Sensitivity | Fogging Density | Remarks |
|---|---|---|---|---|
| 1* | 100 | 100 | 0.20 | Comparative Example |
| 1 | 95 | 93 | 0.21 | Comparative Example |
| 2 | 82 | 76 | 0.17 | Comparative Example |
| 3 | 80 | 73 | 0.17 | Comparative Example |
| 4 | 73 | 68 | 0.17 | Comparative Example |
| 5 | 120 | 128 | 0.19 | Present Invention |
| 6 | 90 | 95 | 0.45 | Comparative Example |
| 7 | 129 | 140 | 0.19 | Present Invention |
| 8 | 128 | 133 | 0.19 | Present Invention |
| 9 | 124 | 132 | 0.18 | Present Invention |

TABLE 1-6-continued

| Sample | 1/100" Sensitivity | 10" Sensitivity | Fogging Density | Remarks |
|---|---|---|---|---|
| 10 | 101 | 110 | 0.33 | Comparative Example |
| 11 | 98 | 105 | 0.34 | Comparative Example |
| 12 | 95 | 103 | 0.36 | Comparative Example |

*represents results of sensitometry obtained immediately after coating.

When the same test was performed for each of the ascorbic acid compounds A-2 to A-10, the same effects were obtained.

EXAMPLE 2

In a process of forming an emulsion following the same procedures as the emulsion preparing method described in Example 1, $2\times10^{-3}$ mol of L-ascorbic acid per mol of silver were added at the following addition times, thereby preparing emulsions. At the same time, $3\times10^{-5}$ mol of a thiosulfonic acid compound 1-2 per mol of silver were added during grain formation, one minute before shell formation was started, and after grain formation and before washing, thereby preparing emulsions.

Addition Time of L-ascorbic Acid a Before grain formation was started
b One minute after shell formation was started
c Immediately after shell formation was completed
d Immediately before chemical sensitization was started Addition Time of Thiosulfonic Acid Compound A One minute before shell formation was started
B After grain formation and before washing The prepared emulsions were optimally subjected to chemical sensitization by gold-plus-sulfur to prepare emulsions 13 to 24 as listed in Table 2-1.

TABLE 2-1

| Emulsion | L-ascorbic Acid Addition Time | Thiosulfonic Acid Addition Time |
|---|---|---|
| 13 | a | No Addition |
| 14 | " | A |
| 15 | " | B |
| 16 | b | No Addition |
| 17 | " | A |
| 18 | " | B |
| 19 | c | No Addition |
| 20 | " | A |
| 21 | " | B |
| 22 | d | No Addition |
| 23 | " | A |
| 24 | " | B |

These emulsions were coated following the same procedures as in Example 1 to perform sensitometry estimation, thereby obtaining the results shown in Table 2-2. Similar to Example 1, sensitivities are estimated as relative sensitivities assuming that the sensitivity of Em-1 optimally subjected to gold-plus-sulfur sensitization is 100.

TABLE 2-2

| Emulsion | 1/100" Sensitivity | 10" Sensitivity | Fogging Density | Remarks |
|---|---|---|---|---|
| 13 | 115 | 120 | 0.21 | Present Invention |
| 14 | 125 | 130 | 0.20 | Present Invention |
| 15 | 113 | 120 | 0.20 | Present Invention |
| 16 | 121 | 130 | 0.19 | Present Invention |
| 17 | 130 | 140 | 0.19 | Present Invention |
| 18 | 126 | 133 | 0.20 | Present Invention |
| 19 | 115 | 123 | 0.22 | Present Invention |
| 20 | 120 | 126 | 0.21 | Present Invention |
| 21 | 120 | 122 | 0.21 | Present Invention |
| 22 | 110 | 115 | 0.22 | Present Invention |
| 23 | 116 | 121 | 0.22 | Present Invention |
| 24 | 115 | 120 | 0.20 | Present Invention |
| 1 | 100 | 100 | 0.20 | Comparative Example |

In this case, the emulsions Em-16 and Em-17 were prepared by adding the same ascorbic acid and thiosulfonic acid (I-2) at the same times as in the preparation of the emulsions Em-5 and Em-7, respectively. As is apparent from Tables 1-5 and 2-2, the emulsions Em-16 and Em-5 and the emulsions Em-17 and Em-7 had the same sensitivity and fogging density, respectively. That is, the effects of the present invention have good reproducibility. As is apparent from Table 2-2, each emulsion of the present invention had high sensitivity and low fogging density. When each coated sample wa aged following the same procedures as in Example 1 and its photographic properties were estimated, the same results as in Example 1 were obtained.

EXAMPLE 3

The following dyes were added to the chemically sensitized emulsions prepared in Example 1 as shown in Table 3-1, thereby preparing spectrally sensitized emulsions.

The prepared emulsions were coated following the same procedures as in Example 1 to perform a sensitometry test.

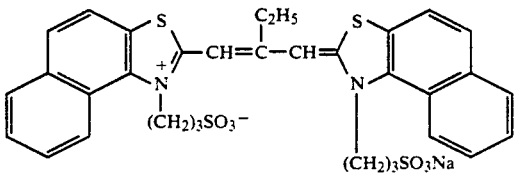

II

-continued

III

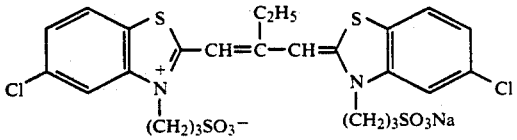

IV

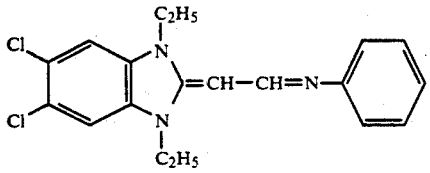

V

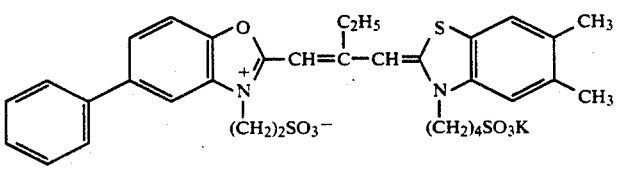

VI

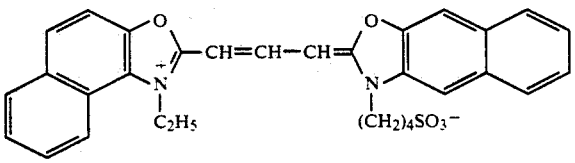

VII

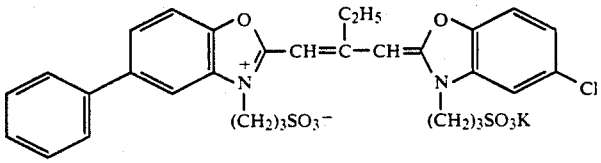

VIII

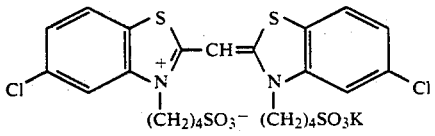

IX

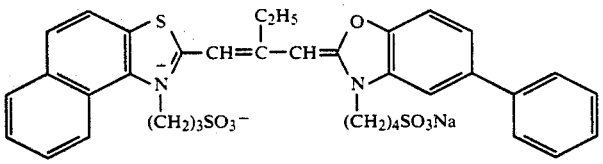

| | |
|---|---|
| Dye Group 1 (Red-Sensitive Dye) | |
| Sensitizing Dye IX | $5.4 \times 10^{-5}$ mol/molAg |
| Sensitizing Dye II | $1.4 \times 10^{-5}$ mol/molAg |
| Sensitizing Dye III | $2.4 \times 10^{-4}$ mol/molAg |
| Sensitizing Dye IV | $3.1 \times 10^{-5}$ mol/molAg |
| Dye Group 2 (Green-Sensitive Dye) | |
| Sensitizing Dye V | $3.5 \times 10^{-5}$ mol/molAg |
| Sensitizing Dye VI | $8.0 \times 10^{-5}$ mol/molAg |
| Sensitizing Dye VII | $3.0 \times 10^{-4}$ mol/molAg |
| Dye Group 3 (Blue-Sensitive Dye) | |
| Sensitizing Dye VIII | $2.2 \times 10^{-4}$ mol/molAg |

TABLE 3-1

| Spectrally Sensitized Emulsion | Chemically Sensitized and Spectrally Non-sensitized Emulsion | Sensitizing Dye Group |
|---|---|---|
| Em - 25 | Em - 1 | 1 |
| Em - 26 | " | 2 |
| Em - 27 | " | 3 |
| Em - 28 | " | 1 |
| Em - 29 | " | 2 |
| Em - 30 | " | 3 |
| Em - 31 | Em - 7 | 1 |
| Em - 32 | " | 2 |
| Em - 33 | " | 3 |

The sensitometry test was performed following the same procedures as in Example 1 except that the emulsions added with the red- or green-sensitive dyes were exposed by using a yellow filter (SC-52 (tradename):

available from Fuji Photo Film Co. Ltd.) in place of the blue filter used in Example 1 and the emulsions added with the blue-sensitive dye were exposed without using a filter. Table 3-2 shows sensitivities of Em-28 to Em-33 as relative sensitivities assuming that sensitivities of Em-25, Em-26, and Em-27 are 100 with respect to ten-sec and 1/100-sec exposures (Each fogging density is a value with respect to a non-exposed portion and was the same for both 1/100" and 10").

TABLE 3-2

| Emulsion | 1/100" Sensitivity | 10" Sensitivity | Fogging Density | Remarks |
|---|---|---|---|---|
| Em-25 | 100 | 100 | 0.22 | Comparative Example |
| 26 | 100 | 100 | 0.21 | Comparative Example |
| 27 | 100 | 100 | 0.20 | Comparative Example |
| 28 | 112 | 120 | 0 21 | Present Invention |
| 29 | 115 | 122 | 0.20 | Present Invention |
| 30 | 120 | 130 | 0.19 | Present Invention |
| 31 | 115 | 120 | 0.20 | Present Invention |
| 32 | 120 | 125 | 0.19 | Present Invention |
| 33 | 125 | 135 | 0.20 | Present Invention |

As is apparent from Table 3-2, each emulsion of the present invention had high sensitivity and low fogging density even after it was subjected to spectral sensitization.

EXAMPLE 4

A plurality of layers having the following compositions were coated on an undercoated triacetylcellulose film support to prepare a sample of a multilayer color light-sensitive material.

Light-Sensitive Layer Composition

Numerals corresponding to the respective components indicate coating amounts in units of g/m$^2$. A coating amount of silver halide is represented in units of g/m$^2$ of silver. A coating amount of the sensitizing dye is represented in units of mols per mol of the silver halide in the same layer.

| (Sample) | | |
|---|---|---|
| Layer 1: Antihalation Layer | | |
| Black Colloid Silver | silver | 0.18 |
| Gelatin | | 1.40 |
| Layer 2: Interlayer | | |
| 2,5-di-t-pentadecylhydroquinone | | 0.18 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| Gelatin | | 1.04 |
| Layer 3: 1st Red-Sensitive Emulsion Layer | | |
| Monodisperse Silver Iodobromide Emulsion (silver iodide = 6 mol %, average grain size = 0.6 μm. variation coefficient of grain size = 0.15) | silver | 0.55 |
| Sensitizing Dye I | | $6.9 \times 10^{-5}$ |
| Sensitizing Dye II | | $1.8 \times 10^{-5}$ |
| Sensitizing Dye III | | $3.1 \times 10^{-4}$ |

-continued

| (Sample) | | |
|---|---|---|
| Sensitizing Dye IV | | $4.0 \times 10^{-5}$ |
| EX-2 | | 0.350 |
| HBS-1 | | 0.005 |
| EX-10 | | 0.020 |
| Gelatin | | 1.20 |
| Layer 4: 2nd Red-Sensitive Emulsion Layer | | |
| Tabular Silver Iodobromide Emulsion (silver iodide = 10 mol %, average grain size = 0.7 μm, average aspect ratio = 5.5, average thickness = 0.2 μm) | silver | 1.0 |
| Sensitizing Dye I | | $5.1 \times 10^{-5}$ |
| Sensitizing Dye II | | $1.4 \times 10^{-5}$ |
| Sensitizing Dye III | | $2.3 \times 10^{-4}$ |
| Sensitizing Dye IV | | $3.0 \times 10^{-5}$ |
| EX-2 | | 0.400 |
| EX-3 | | 0.050 |
| EX-10 | | 0.015 |
| Gelatin | | 1.30 |
| Layer 5: 3rd Red-Sensitive Emulsion Layer | | |
| Silver Iodobromide Emulsion I | silver | 1.60 |
| EX-3 | | 0.240 |
| EX-4 | | 0.120 |
| HBS-1 | | 0.22 |
| HBS-2 | | 0.10 |
| Gelatin | | 1.63 |
| Layer 6: Interlayer | | |
| EX-5 | | 0.040 |
| HBS-1 | | 0.020 |
| Gelatin | | 0.80 |
| Layer 7: 1st Green-Sensitive Emulsion Layer | | |
| Tabular Silver Iodobromide Emulsion (silver iodide = 6 mol %, average grain size = 0.6 μm. average aspect ratio = 6.0. average thickness = 0.15 μm) | silver | 0.40 |
| Sensitizing Dye V | | $3.0 \times 10^{-5}$ |
| Sensitizing Dye VI | | $1.0 \times 10^{-4}$ |
| Sensitizing Dye VII | | $3.8 \times 10^{-4}$ |
| EX-6 | | 0.260 |
| EX-1 | | 0.021 |
| EX-7 | | 0.030 |
| EX-8 | | 0.025 |
| HBS-1 | | 0.100 |
| HBS-4 | | 0.010 |
| Gelatin | | 0.75 |
| Layer 8: 2nd Green-Sensitive Emulsion Layer | | |
| Monodisperse Silver Iodobromide Emulsion (silver iodide = 9 mol %. average grain size = 0.7 μm, variation coefficient of grain size = 0.18) | silver | 0.80 |
| Sensitizing Dye V | | $2.1 \times 10^{-5}$ |
| Sensitizing Dye VI | | $7.0 \times 10^{-5}$ |
| Sensitizing Dye VII | | $2.6 \times 10^{-4}$ |
| EX-6 | | 0.180 |
| EX-8 | | 0.010 |
| EX-1 | | 0.008 |
| EX-7 | | 0.012 |
| HBS-1 | | 0.160 |
| HBS-4 | | 0.008 |
| Gelatin | | 1.10 |
| Layer 9: 3rd Green-Sensitive Emulsion Layer | | |
| Silver Iodobromide Emulsion II | silver | 1.2 |
| EX-6 | | 0.065 |
| EX-11 | | 0.030 |
| EX-1 | | 0.025 |
| HBS-1 | | 0.25 |
| HBS-2 | | 0.10 |
| Gelatin | | 1.74 |
| Layer 10: Yellow Filter Layer | | |
| Yellow Colloid Silver | silver | 0.05 |
| EX-5 | | 0.08 |
| HBS-3 | | 0.03 |
| Gelatin | | 0.95 |
| Layer 11: 1st Blue-Sensitive Emulsion Layer | | |
| Tabular Silver Iodobromide Emulsion (silver iodide = 6 mol %, average grain size = 0.6 μm. | silver | 0.24 |

-continued

| (Sample) | | |
|---|---|---|
| average aspect ratio = 5.7, average thickness = 0.15 μm) | | |
| Sensitizing Dye VIII | | $3.5 \times 10^{-4}$ |
| EX-9 | | 0.8 |
| EX-8 | | 0.12 |
| HBS-1 | | 0.28 |
| Gelatin | | 1.28 |
| Layer 12: 2nd Blue-Sensitive Emulsion Layer | | |
| Monodisperse Silver Iodobromide Emulsion (silver iodide = 10 mol %, average grain size = 0.8 μm, variation coefficient of grain size = 0.16) | silver | 0.45 |
| Sensitizing Dye VIII | | $2.1 \times 10^{-4}$ |
| EX-9 | | 0.20 |
| EX-10 | | 0.015 |
| HBS-1 | | 0.03 |
| Gelatin | | 0.46 |
| Layer 13: 3rd Blue-Sensitive Emulsion Layer | | |
| Silver Iodobromide Emulsion III | silver | 0.77 |
| EX-9 | | 0.20 |
| HBS-1 | | 0.07 |
| Gelatin | | 0.69 |
| Layer 14: 1st Protective Layer | | |
| Silver Iodobromide Emulsion (silver iodide = 1 mol %, average grain size = 0.07 μm) | silver | 0.5 |
| U-4 | | 0.11 |
| U-5 | | 0.17 |
| HBS-1 | | 0.90 |
| Gelatin | | 1.00 |
| Layer 15: 2nd Protective Layer | | |
| Polymethylacrylate Grains (diameter = about 1.5 μm) | silver | 0.54 |
| S-1 | | 0.15 |
| S-2 | | 0.05 |
| Gelatin | | 0.72 |

In addition to the above components, a gelatin hardener H-1 and/or a surfactant were added to each layer.

Formulas of the used compounds are listed in Table B.

Samples 401 to 403 were prepared following the same procedures as the above described sample except that the silver iodobromide emulsions I, II, and III in the layers 5, 9, and 13, respectively, were changed.

These samples were subjected to sensitometry exposure to perform the following color development.

| | |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The processing solution compositions used in the respective steps were as follows.

| | |
|---|---|
| Color Development Solution | |
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-ethyl-N-β-hydroxyethylamino)-2-methylanilinesulfate | 4.5 g |
| Water to make | 1.0 l |
| pH | 10.0 |
| Bleaching Solution | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 |
| pH | 6.0 |
| Fixing Solution | |
| Disodium Ethylenediaminetetraacetate | 1.0 g |
| Sodium Sulfite | 4.0 g |
| Ammonium Thiosulfate Aqueous solution (70) | 175.0 ml |
| Sodium Bisulfite | 4.6 g |
| Water to make | 1.0 l |
| pH | 6.6 |
| Stabilizing Solution | |
| Formalin (40%) | 2.0 ml |
| Polyoxyethylene-p-monononyl-phenylether (average polymerization degree = 10) | 0.3 g |
| Water to make | 1.0 l |

TABLE 4 - 1

| Sample | Emulsion of layer 5 | Emulsion of layer 9 | Emulsion of layer 13 | 1/100" Sensitivity | 10" Sensitivity | Fogging Density | Remarks |
|---|---|---|---|---|---|---|---|
| 401 | Em - 25 | Em - 26 | Em - 27 | R 100 | R 100 | R 0.22 | Comparative |
| | | | | G 100 | G 100 | G 0.23 | Example |
| | | | | B 100 | B 100 | B 0.21 | |
| 402 | Em - 28 | Em - 29 | Em - 30 | R 100 | R 119 | R 0.20 | Present |
| | | | | G 114 | G 121 | G 0.20 | Invention |
| | | | | B 121 | B 128 | B 0.19 | |
| 403 | Em - 31 | Em - 32 | Em - 33 | R 116 | R 119 | R 0.19 | Present |
| | | | | G 121 | G 122 | G 0.20 | Invention |
| | | | | B 122 | B 133 | B 0.19 | |

The processed samples were subjected to density measurement by using red, green, and blue filters. The obtained results are shown in Table 4-1.

The results of photographic properties are represented by relative sensitivities of the red-, green-, and blue-sensitive layers assuming that the sensitivity of the sample 401 is 100. Processing Method

The color development process was performed at 38° C. in accordance with the following process steps.

As is apparent from Table 4-1, the emulsions of the present invention have an effect of increasing the sensitivity with almost no increase in fogging density.

When photographic properties were checked after aging following the same procedures as in Example 1, the samples using the emulsions of the present invention had good storage stability.

EXAMPLE 5

The samples 401 to 403 of the present invention and the comparative examples were exposed following the same procedures as in Example 4 and processed as follows by using an automatic developing machine.

| Step | Processing Method Time | Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Drying | 1 min. 15 sec. | 55° C. |

The processing solution compositions will be described below.

| Color Developing Solution | (g) |
|---|---|
| Diethylenetriaminepentaacetic Acid | 1.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |

| Bleaching Solution | (g) |
|---|---|
| Ferric Ammonium Ethylenediaminetetraacetate Dihydrate | 120.0 |
| Disodium Ethylenediaminetetraacetate | 10.0 |
| Ammonium Bromide | 100.0 |
| Ammonium Nitrate | 10.0 |
| Bleaching Accelerator | 0.005 mol |

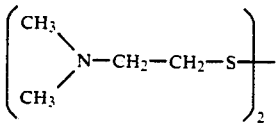

| | |
|---|---|
| Ammonia Water (27%) | 15.0 ml |
| Water to make | 1.0 l |
| pH | 6.3 |

| Bleach-Fixing Solution | (g) |
|---|---|
| Ferric Ammonium Ethylenediaminetetraacetate Dihydrate | 50.0 |
| Disodium Ethylenediaminetetraacetate | 5.0 |
| Sodium Sulfite | 12.0 |
| Ammonium Thiosulfate Aqueous Solution (70%) | 240.0 ml |
| Ammonia Water (27%) | 6.0 ml |
| Water to make | 1.0 l |
| pH | 7.2 |

Washing Solution

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution fell within the range of 6.5 to 7.5.

| Stabilizing Solution | (g) |
|---|---|
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 l |
| pH | 5.0 to 8.0 |

The samples 402 and 403 of the present invention provided the good results as in Example 4 after they were subjected to the above processing.

EXAMPLE 6

The samples 401 to 403 of the present invention and the comparative examples were exposed following the same procedures as in Example 4 and processed as follows by using an automatic developing machine.

| Step | Processing Method Time | Temperature |
|---|---|---|
| Color development | 2 min. 30 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The processing solution compositions will be described below.

| Color Developing Solution | (g) |
|---|---|
| Diethylenetriaminepentaacetic Acid | 2.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |

| Bleach-Fixing Solution | (g) |
|---|---|
| Ferric Ammonium Ethylenediaminetetraacetate Dihydrate | 50.0 |
| Disodium Ethylenediaminetetraacetate | 5.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |

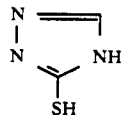

| | |
|---|---|
| Water to make | 1.0 l |
| pH | 6.0 |

Washing Solution

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution fell within the range of 6.5 to 7.5.

-continued

| Stabilizing Solution | (g) |
|---|---|
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 l |
| pH | 5.0 to 8.0 |

The samples 402 and 403 of the present invention provided the good results as in Example 4 after they were subjected to the above processing.

EXAMPLE 7

A plurality of layers having the following compositions were coated on an undercoated cellulose triacetate film support to prepare a sample as a multilatered color light-sensitive material.

Compositions of Light-Sensitive Layers

The amounts are represented in units of g/m$^2$. The coated amounts of a silver halide and colloid silver are represented in units of g/m$^2$ of silver, and that of sensitizing dyes is represented by the number of mols per mol of the silver halide in the same layer.

| | |
|---|---|
| Layer 1: Antihalation Layer | |
| Black Colloid Silver coated silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07 m) coated silver amount | 0.15 |
| Gelatin | 1.0 |
| Cpd-2 | 0.2 |
| Layer 3: 1st Red-Sensitive emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetradecahedral grain) coated silver amount | 0.26 |
| Silver Iodobromide Emulsion (AgI = 4.0 mol %, internally high AgI type, sphere-ecui,valent diameter = 0.4 μm, variation coefficient of sphere-equivalent diameter = 22%, tetradecahedral grain) coated silver amount | 0.2 |
| Gelatin | 1.0 |
| EXS-1 | 4.5 × 10$^{-4}$ |
| EXS-2 | 1.5 × 10$^{-4}$ |
| EXS-3 | 0.4 × 10$^{-4}$ |
| ExS-4 | 0.3 × 10$^{-4}$ |
| ExC-1 | 0.33 |
| ExC-2 | 0.009 |
| ExC-3 | 0.023 |
| ExC-6 | 0.14 |
| Layer 4: 2nd Red-Sensitive Emulsion Layer | |
| Silver Iodobromide Emulsion (AgI = 16 mol%, internally high AgI type, sphere-equivalent diameter = 1.0 μm, variation coefficient of sphere-equivalent diameter = 25%, tabular grain, diameter/thickness ratio = 4.0) coated silver amount | 0.55 |
| Gelatin | 0.7 |
| ExS-1 | 3 × 10$^{-4}$ |
| ExS-2 | 1 × 10$^{-4}$ |
| ExS-3 | 0.3 × 10$^{-4}$ |
| ExS-4 | 0.3 × 10$^{-4}$ |
| ExC-3 | 0.05 |
| ExC-4 | 0.10 |
| ExC-6 | 0.08 |
| Layer 5: 3rd Red-Sensitive Emulsion Layer | |
| Silver Iodobromide Emulsion I (internally high AgI type, sphere-equivalent diameter = 1.2 μm, variation coefficient of sphere-equivalent diameter = 28%) coated silver amount | 0.9 |
| Gelatin | 0.6 |
| ExS-1 | 2 × 10$^{-4}$ |
| EXS-2 | 0.6 × 10$^{-4}$ |
| EXS-3 | 0.2 × 10$^{-4}$ |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetra-decahedral grain) coated silver amount | 0.2 |
| Silver Iodobromide Emulsion (AgI = 4.0 mol %, internally high AgI type, sphere-equivalent diameter = 0.4 μm, variation coefficient of sphere-equivalent diameter = 22%, tetra-decahedral grain) coated silver amount | 0.1 |
| Gelatin | 1.2 |
| ExS-5 | 5 × 10$^{-4}$ |
| ExS-6 | 2 × 10$^{-4}$ |
| ExS-7 | 1 × 10$^{-4}$ |
| ExM-1 | 0.41 |
| ExM-2 | 0.10 |
| ExM-5 | 0.03 |
| Solv-1 | 0.2 |
| Solv-5 | 0.03 |
| Layer 8: 2nd Green-Sensitive Emulsion Layer | |
| Silver Iodobromide Emulsion (AgI = 10 mol %, internally high iodide type, sphere-equivalent diameter = 1.0 μm, variation coefficient of sphere-equivalent diameter = 25%, tabular grain, diameter/thickness ratio = 3.0) coated silver amount | 0.4 |
| Gelatin | 0.35 |
| ExS-5 | 3.5 × 10$^{-4}$ |
| ExS-6 | 1.4 × 10$^{-4}$ |
| ExS-7 | 0.7 × 10$^{-4}$ |
| ExM-1 | 0.09 |
| ExM-3 | 0.01 |
| Solv-1 | 0.15 |
| Solv-5 | 0.03 |
| Layer 9: Interlayer | |
| Gelatin | 0.5 |
| Layer 10: 3rd Green-Sensitive Emulsion Layer | |
| Silver Iodobromide emulsion II (internally high AgI type, sphere-equivalent diameter = 1.2 μm, variation coefficient of sphere-equivalent diameter = 28%) coated silver amount | 1.0 |
| Gelatin | 0.8 |
| ExS-5 | 2 × 10$^{-4}$ |
| ExS-6 | 0.8 × 10$^{-4}$ |
| ExS-7 | 0.8 × 10$^{-4}$ |
| ExM-3 | 0.01 |
| ExM-4 | 0.04 |
| ExC-4 | 0.005 |
| Solv-1 | 0.2 |
| Layer 11: Yellow Filter Layer | |
| Cpd-3 | 0.05 |
| Gelatin | 0.5 |

-continued

| | |
|---|---|
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide type, sphere-equivalent diameter = 0.7 μm, variation coefficient of sphere-equivalent diameter = 14%, tetra-decahedral grain) coated silver amount | 0.1 |
| Silver Iodobromide Emulsion (AgI = 4.0 mol μ, internally high iodide type, sphere-equivalent diameter = 0.4 μm, variation coefficient of sphere-equivalent diameter = 22%, tetra-decahedral graih) coated silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI type, sphere-equivalent diameter = 1.0 μm, variation coefficient of sphere-equivalent diameter = 16%, tetra-decahedral grain) coated silver amount | 0.19 |
| Gelatin | 0.3 |
| ExS-8 | $2 \times 10^{-4}$ |
| ExY-1 | 0.22 |
| Solv-1 | 0.07 |
| Layer 15: Interlayer | |
| Fine Silver Iodobromide Grain (AgI = 2 mol %, homogeneous type, sphere-equivalent diameter = 0.13 μm) coated silver amount | 0.2 |
| Gelatin | |
| Layer 16: 3rd Blue-Sensitive Emulsion Layer | |
| Silver Iodobromide Emulsion III (internally high AgI type, sphere-equivalent diameter = 1.2 μm, variation coefficient of sphere-equivalent diameter = 28%) coated silver amount | 1.0 |
| Gelatin | 0.5 |
| ExS-8 | $1.5 \times 10^{-4}$ |
| ExY-1 | 0.2 |
| Solv-4 | 0.07 |
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07 μm) coating silver amount | 0.18 |
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

Formulas of the compounds used are listed in Table C.

Samples 701 to 703 were prepared following the same procedures as for the above sample except that the silver iodobromide emulsions I, II, and III in the layers 5, 10, and 16, respectively, were changed.

These samples were left under conditions of a temperature of 40° C. and a relative humidity of 70% for 14 hours and then subjected to sensitometry exposure to perform color development following the same procedures as in Example 4.

The processed samples were subjected to density measurement by using red, green, and blue filters. The results obtained are shown in Table 7-1.

The results of photographic properties are represented by relative sensitivities of the red-, green-, and blue-sensitive layers assuming that the sensitivity of the sample 701 is 100.

As is apparent from Table 7-1, the emulsions of the present invention have an effect of increasing the sensitivity with almost no increase in fogging density.

When the samples were aged following the same procedures as in Example 1 and their photographic properties were checked, the samples 702 and 703 using the emulsions of the present invention provided good photographic properties.

TABLE 7-1

| Sample | Emulsion of layer 5 | Emulsion of layer 10 | Emulsion of layer 16 | 1/100" Sensitivity | 10" Sensitivity | Fogging Density | Remarks |
|---|---|---|---|---|---|---|---|
| 701 | Em - 1 | Em - 1 | Em - 1 | R 100 | R 100 | R 0.24 | Comparative |
| | | | | G 100 | G 100 | G 0.23 | Example |
| | | | | B 100 | B 100 | B 0.24 | |
| 702 | Em - 5 | Em - 5 | Em - 7 | R 109 | R 118 | R 0.23 | Present |
| | | | | G 116 | G 122 | G 0.21 | Invention |
| | | | | B 122 | B 130 | B 0.22 | |
| 703 | Em - 7 | Em - 8 | Em - 9 | R 112 | R 115 | R 0.22 | Present |
| | | | | G 125 | G 130 | G 0.21 | Invention |
| | | | | B 128 | B 135 | B 0.21 | |

*R, G, and B represent red, green, and blue sensitivities, respectively. A fogging density represents a value obtained by subtracting that of the same sample subjected only to the same fixing and stabilizing steps as described in the text.

EXAMPLE 8

A plurality of layers having the following compositions were coated on an undercoated triacetylcellulose film support to prepare a sample as a multilayered color light-sensitive material.

Compositions of Light-Sensitive Layers

The coated amount of a silver halide and colloid silver are represented in units of g/m$^2$ of silver, that of couplers, additives, and gelatin is represented in units of g/m$^2$, and that of sensitizing dye is represented by the number of mols per mol of the silver halide in the same layer. Symbols representing additives have the following meanings. Note that if an additive has a plurality of effects, only one of the effects is shown.

UV: ultraviolet absorbent; Solv: high-boiling organic solvent; ExF: dye; ExS: sensitizing dye; ExC: cyan coupler; ExM: magenta coupler; ExY: yellow coupler; Cpd: additive.

| | |
|---|---|
| Layer 1: Antihalation Layer | |
| Black Colloid Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Layer 2: Low-Sensitivity Red-Sensitive Emulsion Layer | |
| Silver Iodobromide Emulsion (AgI = 4 mol %, homogeneous type, sphere-equivalent diameter = 0.4 μm, variation coefficient of sphere-equivalent diameter = 37%, tabular grain, diameter/thickness ratio = 3.0) coated silver amount | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| Layer 3: Intermediate-Sensitivity Red-Sensitive Emulsion Layer | |
| Silver Iodobromide Emulsion (AgI = 6 mol %, internally high AgI type having core/shell ratio of 2:1, sphere-equivalent diameter = 0.65 μm, variation coefficient of sphere-equivalent diameter = 25%, tabular grains, diameter/thickness ratio = 2.0) coated silver amount | 0.65 |
| Silver Iodobromide Emulsion (AgI = 4 mol %, homogeneous AgI type, sphere-equivalent diameter = 0.4 μm, variation coefficient of sphere-equivalent diameter = 37%, tabular grain, diameter/thickness ratio = 3.0) coated silver amount | 0.1 |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| Layer 4: High-Sensitivity Red-Sensitivity Emulsion Layer | |
| Silver Iodobromide Emulsion I (internally high AgI type having core/shell ratio of 1:2, sphere-equivalent diameter = 0.75 μm, variation coefficient of sphere-equivalent diameter = 25%) coated silver amount | 0.9 |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Layer 5: Interlayer | |
| Gelatin | 0.6 |
| UV-4 | 0.03 |
| UV-5 | 0.04 |
| Cpd-1 | 0.1 |
| Polyethylacrylate Latex | 0.08 |
| Solv-1 | 0.05 |
| Layer 6: Low-Sensitivity Green-Sensitive Emulsion Layer | |
| Silver Iodobromide Emulsion (AgI = 4 mol %, homogeneous type, sphere-equivalent diameter = 0.7 μm, variation coefficient of sphere equivalent diameter = 37%, tabular grain, diameter/thickness ratio = 2.0) coated silver amount | 0.18 |
| Gelatin | 0.4 |
| ExS-3 | $2 \times 10^{-4}$ |

-continued

| | |
|---|---|
| ExS-4 | $7 \times 10^{-4}$ |
| ExS-5 | $1 \times 10^{-4}$ |
| EXM-5 | 0.11 |
| ExM-7 | 0.03 |
| ExY-8 | 0.01 |
| Solv-1 | 0.09 |
| Solv-4 | 0.01 |
| Layer 7: Intermediate-Sensitivity Green-Sensitive Emulsion Layer | |
| Silver Iodobromide Emulsion (AgI = 4 mol %, surface high AgI type having core/shell ratio of 1:1, sphere-equivalent type, sphere-equivalent diameter = 0.5 μm, variation coefficient of sphere-equivalent diameter = 20%, tabular grain, diameter/thickness ratio = 4.0) coated silver amount | 0.27 |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Layer 8: High-Sensitivity Green-Sensitive Emulsion Layer | |
| Silver Iodobromide Emulsion II (internally high AgI type having core/shell ratio of 1:2, sphere-equivalent diameter = 0.75 μm, variation coefficient of sphere-equivalent diameter = 25%) coated silver amount | 0.7 |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Layer 9: Interlayer | |
| Gelatin | 0.6 |
| Cpd-1 | 0.04 |
| Polyethylacrylate Latex | 0.12 |
| Solv-1 | 0.02 |
| Layer 10: Donor Layer having Interlayer Effect on Red-Sensitive Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.0) coated silver amount | 0.68 |
| Silver Iodobromide Emulsion (AgI = 4 mol %, homogeneous type, variation coefficient of sphere-equivalent diameter = 37%, tabular grain, diameter/thickness ratio = 3.0) coated silver amount | 0.19 |
| Gelatin | 1.0 |
| ExS-3 | $6 \times 10^{-4}$ |
| ExM-10 | 0.19 |
| Solv-1 | 0.20 |
| Layer 11: Yellow Filter Layer | |
| Yellow Colloid Silver | 0.06 |
| Gelatin | 0.8 |
| Cpd-2 | 0.13 |
| Solv-1 | 0.13 |
| Cpd-1 | 0.07 |
| H-1 | 0.13 |
| Layer 12: Low-Sensitivity Blue-Sensitive Emulsion Layer | |
| Silver Iodobromide Emulsion (AgI = 4.5 mol %, homogeneous AgI type, sphere-equivalent diameter = 0.7 μm, variation coefficient of | 0.3 |

-continued

| | |
|---|---|
| sphere-equivalent diameter = 15%, tabular grain, diameter/thickness ratio = 7.0) coated silver amount | |
| Silver Iodobromide Emulsion (AgI = 3 mol %, homogeneous AgI type, sphere-equivalent diameter = 0.3 μm, variation coefficient of sphere-equivalent diameter = 30%, tabular grain, diameter/thickness ratio = 7.0) coated silver amount | 0.15 |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Layer 13: Interlayer | |
| Gelatin | 0.7 |
| ExY-12 | 0.20 |
| Solv-1 | 0.34 |
| Layer 14: High-Sensitivity Blue-Sensitive Emulsion Layer | |
| Silver Iodobromide Emulsion III (internally high AgI type having core/shell ratio of 1: 2, sphere-equivalent diameter = 0.75 μm, variation coefficient of sphere-equivalent diameter = 25%) coated silver amount | 0.5 |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| Layer 15: 1st Protective Layer | |
| Fine Grain Silver Bromide Emulsion (AgI = 2 mol %, homogeneous AgI type, sphere-equivalent diameter = 0.07 μm) coated silver amount | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethylacrylate Latex | 0.09 |
| Layer 16: 2nd Protective Layer | |
| Fine Grain Silver Bromide Emulsion (AgI = 2 mol %, homogeneous AgI type, sphere-equivalent diameter = 0.07 μm) coating silver amount | 0.36 |
| Gelatin | 0.55 |
| Polymethylmethacrylate Grain (diameter = 1.5 μm) | 0.2 |
| H-1 | 0.17 |

In addition to the above components, a stabilizer Cpd-3 (0.07 g/m$^2$) for an emulsion and a surfactant Cpd-4 (0.03 g/m$^2$) were added as coating aids to each layer.

Formulas of the used compounds are listed in Table D.

An emulsion Em-201 was prepared following the same procedures as for Em-1 in Example 1 except that the average sphere-equivalent diameter of a seed crystal was 0.5 μm and therefore the average sphere-equivalent diameter of a final grain was 0.75 μm.

A thiosulfonic acid compound and a reduction sensitizer were added in amounts listed in Table 8-1 to Em-201 following the same procedures as in Example 1, thereby preparing emulsions 202 to 207.

TABLE 8-1

| Emulsion | Thiosulfonic Acid Compound Addition Amount/mol Ag | | Reduction Sensitizer Addition Amount/mol Ag | |
|---|---|---|---|---|
| 202 | No Addition | No Addition | Tin Chloride | $1.2 \times 10^{-5}$ mol |
| 203 | 1-2 | $2 \times 10^{-5}$ mol | Tin Chloride | " |
| 204 | No Addition | No Addition | L-ascorbic Acid | $2.1 \times 10^{-3}$ mol |
| 205 | 1-2 | $2 \times 10^{-5}$ mol | L-ascorbic Acid | " |
| 206 | 1-6 | " | L-ascorbic Acid | " |
| 207 | 1-16 | " | L-ascorbic Acid | " |

The emulsions 201 to 207 of the present invention and the comparative examples prepared as described above were optimally subjected to gold-plus-sulfur-sensitization by using a sodium thiosulfate and chloroauric acid.

Samples 801 to 804 were prepared following the same procedures as for the above sample except that the silver iodobromide emulsions I, II, and III in the layers 4, 8, and 14, respectively, were changed.

These samples were left under conditions of a temperature of 40° C. and a relative humidity of 70% for 14 hours and then subjected to sensitometry exposure to perform color development following the same procedures as in Example 5.

The processed samples were subjected to density measurement by using red, green, and blue filters.

The results of photographic properties are compared by using relative sensitivities of the red-, green-, and blue-sensitive layers assuming that the sensitivity of the sample 801 is 100.

The results showed that the samples 803 and 804 of the present invention had higher sensitivity and lower fogging density than the samples 801 and 802 of the comparative example. When the samples were aged and stored following the same procedures as in Example 1 and their photographic properties were measured, a fogging density of the sample 802 was significantly increased while its sensitivity was decreased. However, the samples 803 and 804 of the present invention had photographic properties better than those of the comparative examples 801 and 802.

EXAMPLE 9

Samples 1101 to 1110 of multilayered color light-sensitive material having the same layer arrangement as that of Example 4 were prepared following the same procedures as in Example 4 except that the silver iodobromide emulsions I, II, and III of the layers 5, 9, and 13 were changed as shown in Table 9-2. Note that in addition to the emulsions listed in Table 9-2, the sensitizing dyes of the dye groups 1, 2, and 3 of Example 3 were added to the layers 5, 9, and 13, respectively, in the same amounts as those in Example 3.

Methods of preparing tabular silver halide emulsions listed in the table 9-2 will be described below.

An aqueous solution obtained by dissolving 30 g of inactive gelatin and 6 g of potassium bromide in 1 liter of distilled water was stirred at 75° C., and 35 cc of an aqueous solution containing 5.0 g of silver nitrate and 35 cc of an aqueous solution containing 3.2 g of potassium bromide and 0.98 g of potassium iodide were added to the resultant solution each at a rate of 70 cc/min for 30 seconds. Thereafter, the pAg of resultant solution increased to 10 to perform ripening for 30 minutes, thereby preparing a seed emulsion.

Equimolar amounts of a predetermined amount of 1 l of an aqueous solution containing 145 g of silver nitrate and a solution of a mixture of potassium bromide and potassium iodide were added at a predetermined temperature, a predetermined pAg, and an addition rate close to a critical growth rate, thereby preparing a tabular core emulsion.

Subsequently, a thiosulfonic acid compound was added, and one minute after the addition, equimolar amounts of the remaining aqueous silver nitrate solution and an aqueous solution of a mixture of potassium bromide and potassium iodide having a different composition from that used in core emulsion preparation were added at an addition rate close to a critical growth rate to start shell formation. The ascorbic acid compound was added one minute after shell formation was started to continue shell formation, thereby finally preparing a core/shell type silver iodobromide tabular emulsions. An aspect ratio was adjusted by selecting the pAg upon core and/or shell formation. 85% or more of projected areas of all grains of the emulsions prepared as described above were occupied by tabular grains. The average sphere-equivalent diameter of the tabular grains was 1.2 μm, and its average iodide content was 7.6 mol %.

The tabular emulsion grains used in the samples 1101 to 1110 are summarized in Table 9-1.

These samples were subjected to sensitometry exposure (1/100 sec) to perform the color development as described in Example 4.

The processed samples were subjected to density measurement by using red, green, and blue filters. The obtained results are summarized in Table 9-2.

The results of photographic properties are represented by relative sensitivities of the red-, green-, and blue-sensitive layers assuming that the sensitivity of the sample 1101 is 100.

A response to pressure of each sample was evaluated as follows. That is, each sample was wound around a columnar rod having a diameter of 6 mm so that the emulsion surface of the sample faced inward, and held in this state for 10 seconds. Thereafter, wedge exposure was performed under the same conditions as described above for 1/100 seconds, development was performed following the same procedures as described above, and the density was measured by using a blue filter, thereby measuring fog and sensitivity of the blue-sensitive layer. The sensitivity is represented by a relative value assuming that the sensitivity of the sample 1101 was 100.

The sharpness was evaluated by measuring the MTF of the red-sensitive layer. The MTF value was measured in accordance with a method described in "The Theory of Photographic Process", 3rd, ed., Macmillan. Exposure was performed by white light, and cyan color forming density was measured by a red filter. The MTF value with respect to a spatial frequency of 25 cycle/mm at cyan color forming density of 1.0 is used as a typical value. Larger MTF values are more preferable.

TABLE 9-1

| Sample No. | Emulsion No. | Average Aspect Ratio | Average Grain Diameter | Average Grain Thickness | Thiosulfonic Acid Compound: Compound | Thiosulfonic Acid Compound: Addition Amount (per mol of silver) | Ascorbic Acid Compound: Compound | Ascorbic Acid Compound: Addition Amount (per mol of silver) |
|---|---|---|---|---|---|---|---|---|
| 1101 | Em-101 | 2.8 | 1.21 | 0.55 | 1-16 | $3 \times 10^{-5}$ mol | A-1 | $1 \times 10^{-2}$ mol |
| 1102 | Em-102 | 6.7 | 1.74 | 0.30 | " | " | " | " |
| 1103 | Em-103 | 9.8 | 2.10 | 0.25 | " | " | " | " |
| 1104 | Em-104 | 17.4 | 2.75 | 0.18 | " | " | " | " |
| 1105 | Em-105 | The same as Em-102 | | | 1-2 | $3 \times 10^{-5}$ mol | " | " |
| 1106 | Em-106 | The same as Em-103 | | | " | " | " | " |
| 1107 | Em-107 | The same as Em-103 | | | — | — | — | — |
| 1108 | Em-108 | The same as Em-102 | | | — | — | A-1 | $1 \times 10^{-2}$ mol |
| 1109 | Em-109 | The same as Em-102 | | | — | — | — | — |
| 1110 | Em-110 | The same as Em-102 | | | 1-16 | $3 \times 10^{-5}$ mol | — | — |

Average Aspect Ratio: A number-averaged value of aspect ratios obtained by measuring an aspect ratio of each of 1,000 emulsion grains extracted at random, selecting grains corresponding to 50% of a total projected area from those having larger aspect ratios, and calculating a number-averaged value of the aspect ratios of the selected grains.

TABLE 9-2

| Sample No. | Red-Sensitive Layer: Sensitivity | Red-Sensitive Layer: Fog | Green-Sensitive Layer: Sensitivity | Green-Sensitive Layer: Fog | Blue-Sensitive Layer: Sensitivity | Blue-Sensitive Layer: Fog | Blue-Sensitive Layer (After Bending): Sensitivity | Blue-Sensitive Layer (After Bending): Fog | M.T.F. (Red-Sensitive-Layer) | Remarks |
|---|---|---|---|---|---|---|---|---|---|---|
| 1101 | 100 | 0.15 | 100 | 0.18 | 100 | 0.26 | 100 | 0.26 | 0.52 | Comparative Example |
| 1102 | 105 | 0.15 | 105 | 0.17 | 105 | 0.26 | 105 | 0.26 | 0.59 | Present Invention |
| 1103 | 107 | 0.15 | 105 | 0.18 | 105 | 0.27 | 105 | 0.28 | 0.61 | Present Invention |
| 1104 | 107 | 0.16 | 107 | 0.18 | 105 | 0.27 | 102 | 0.29 | 0.63 | Present Invention |
| 1105 | 107 | 0.15 | 107 | 0.18 | 107 | 0.27 | 107 | 0.27 | 0.58 | Present Invention |
| 1106 | 110 | 0.15 | 110 | 0.18 | 107 | 0.27 | 105 | 0.28 | 0.60 | Present Invention |
| 1107 | 93 | 0.13 | 93 | 0.16 | 91 | 0.24 | 83 | 0.28 | 0.61 | Comparative Example |

TABLE 9-2-continued

| Sample No. | Red-Sensitive Layer Sensitivity | Red-Sensitive Layer Fog | Green-Sensitive Layer Sensitivity | Green-Sensitive Layer Fog | Blue-Sensitive Layer Sensitivity | Blue-Sensitive Layer Fog | Blue-Sensitive Layer (After Bending) Sensitivity | Blue-Sensitive Layer (After Bending) Fog | M.T.F. (Red-Sensitive-Layer) | Remarks |
|---|---|---|---|---|---|---|---|---|---|---|
| 1108 | 98 | 0.17 | 98 | 0.19 | 100 | 0.29 | 98 | 0.30 | 0.59 | Present Intention |
| 1109 | 91 | 0.13 | 93 | 0.15 | 91 | 0.24 | 87 | 0.27 | 0.58 | Comparative Example |
| 1110 | 85 | 0.10 | 87 | 0.12 | 85 | 0.21 | 81 | 0.24 | 0.59 | Comparative Example |

As is apparent from Table 9-2, the color photographic light-sensitive material of the present invention has good sharpness and response to pressure while maintaining high sensitivity. As is apparent from a comparison between the samples 1102 and 1108, an emulsion having higher sensitivity and producing lower fog can be obtained by additionally using a thiosulfonic acid compound.

EXAMPLE 10

Samples 1201 to 1210 having the same layer arrangement as that of Example 7 were prepared using the emulsions prepared in Example 9 as silver bromide emulsions I, II, and III of layers 5, 10, and 16, respectively.

These samples were exposed and color-developed following the same procedures as in Example 9, thereby obtaining the results summarized in Table 10-1. The MTF values were values at the cyan color forming density of 1.2.

TABLE 10-1

| Sample No. | Red-Sensitive Layer Sensitivity | Red-Sensitive Layer Fog | Green-Sensitive Layer Sensitivity | Green-Sensitive Layer Fog | Blue-Sensitive Layer Sensitivity | Blue-Sensitive Layer Fog | Blue-Sensitive Layer (After Bending) Sensitivity | Blue-Sensitive Layer (After Bending) Fog | M.T.F. (Red-Sensitive-Layer) | Silver Iodobromide Emulsion |
|---|---|---|---|---|---|---|---|---|---|---|
| 1201 (Comparative Example) | 100 | 0.10 | 100 | 0.13 | 100 | 0.15 | 100 | 0.16 | 0.40 | Em-101 |
| 1202 (Present Invention) | 105 | 0.11 | 105 | 0.14 | 102 | 0.15 | 105 | 0.16 | 0.46 | Em-102 |
| 1203 (Present Invention) | 107 | 0.11 | 105 | 0.14 | 105 | 0.16 | 107 | 0.17 | 0.48 | Em-103 |
| 1204 (Present Invention) | 107 | 0.12 | 107 | 0.14 | 105 | 0.16 | 105 | 0.19 | 0.50 | Em-104 |
| 1205 (Present Invention) | 107 | 0.11 | 107 | 0.13 | 105 | 0.15 | 107 | 0.16 | 0.46 | Em-105 |
| 1206 (Present Invention) | 110 | 0.10 | 107 | 0.13 | 107 | 0.15 | 107 | 0.16 | 0.48 | Em-106 |
| 1207 (Comparative Example) | 93 | 0.10 | 95 | 0.12 | 93 | 0.14 | 85 | 0.18 | 0.48 | Em-107 |
| 1208 (Present Invention) | 98 | 0.13 | 98 | 0.16 | 100 | 0.18 | 98 | 0.20 | 0.46 | Em-108 |
| 1209 (Comparative Example) | 93 | 0.10 | 93 | 0.12 | 93 | 0.14 | 89 | 0.17 | 0.47 | Em-109 |
| 1210 (Comparative Example) | 89 | 0.08 | 87 | 0.11 | 89 | 0.12 | 85 | 0.15 | 0.46 | Em-110 |

As is apparent from Table 10-1, the color photographic light-sensitive material according to the present invention has high sensitivity and good sharpness and response to pressure.

EXAMPLE 11

Samples 1301 to 1310 having the same layer arrangement as that of Example 8 were prepared using the emulsions 101 to 110 prepared in Example 9 as silver iodobromide emulsions I, II, and III of layers 4, 8, and 14, respectively.

These samples were exposed and color-developed following the same procedures as in Example 9. Good results were obtained by samples using the emulsions of the present invention.

TABLE A

| | |
|---|---|
| $CH_3SO_2SNa$ | (1-1) |
| $C_2H_5SO_2SNa$ | (1-2) |
| $C_3H_7SO_2SK$ | (1-3) |
| $C_4H_9SO_2SLi$ | (1-4) |
| $C_6H_{13}SO_2SNa$ | (1-5) |

TABLE A-continued
$C_8H_{17}SO_2SNa$ (1-6)
$CH_3(CH_2)_3CH(C_2H_5)CH_2SO_2S.NH_4$ (1-7)
$C_{10}H_{21}SO_2SNa$ (1-8)
$C_{12}H_{25}SO_2SNa$ (1-9)
$C_{16}H_{33}SO_2SNa$ (1-10)
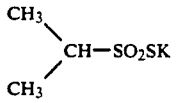
(1-11)
t-$C_4H_9SO_2SNa$ (1-12)
$CH_3OCH_2CH_2SO_2SNa$ (1-13)
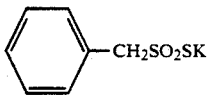
(1-14)
$CH_2{=}CHCH_2SO_2Na$ (1-15)
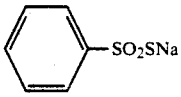
(1-16)
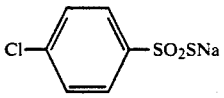
(1-17)
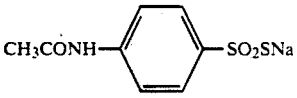
(1-18)
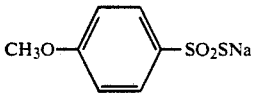
(1-19)
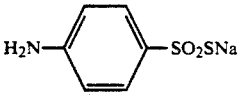
(1-20)
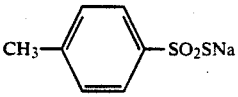
(1-21)
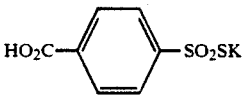
(1-22)
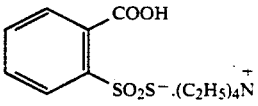
(1-23)
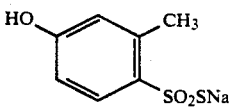
(1-24)
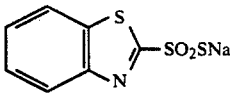
(1-25)
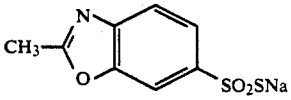
(1-26)
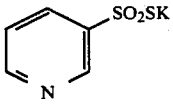
(1-27)
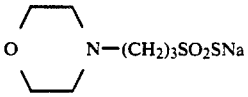
(1-28)
$KSSO_2(CH_2)_2SO_2SK$ (1-29)
$NaSSO_2(CH_2)_4SO_2SNa$ (1-30)
$NaSSO_2(CH_2)_4S(CH_2)_4SO_2SNa$ (1-31)
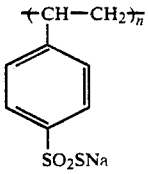
(1-32)
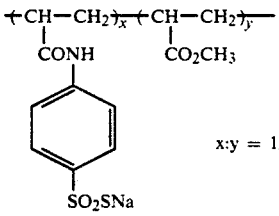
x:y = 1/1 (mole ratio)
(1-33)
$C_2H_5SO_2SCH_3$ (2-1)
$C_8H_{17}SO_2SCH_2CH_3$ (2-2)
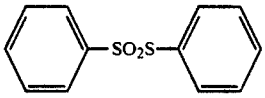
(2-3)
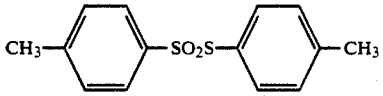
(2-4)
$C_2H_5SO_2SCH_2CH_2CN$ (2-5)
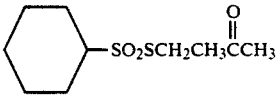
(2-6)

TABLE A-continued
(2-7)
$C_4H_9SO_2S\overset{CH_3}{\overset{|}{C}}HCH_2CN$
(2-8)
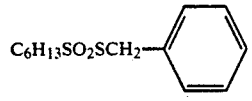
(2-9)
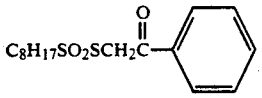
(2-10)
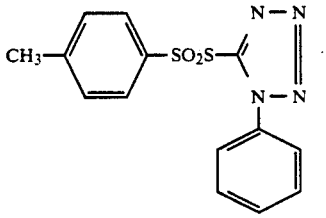
(2-11)
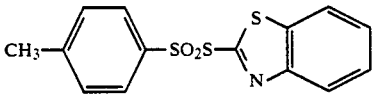
(2-12)
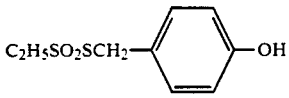
(2-13)
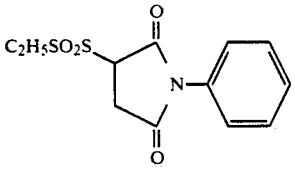
(2-14)
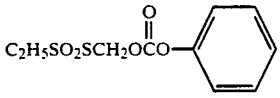
(2-15)
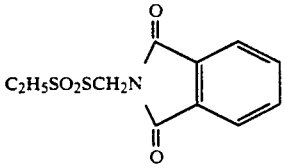
(2-16)
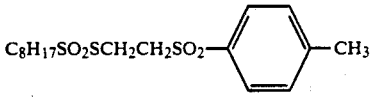
(2-17)
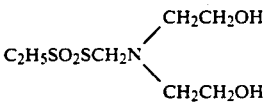
(2-18)
$C_2H_5SO_2SCH_2CH_2CH_2CH_2OH$
TABLE A-continued
(2-19)
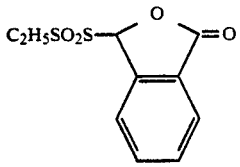
(2-20)
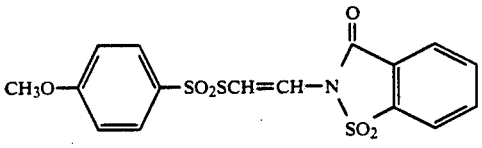
(2-21)
$CH_3SSO_2(CH_2)_4SO_2SCH_3$
(2-22)
$CH_3SSO_2(CH_2)_2SO_2SCH_3$
(2-23)
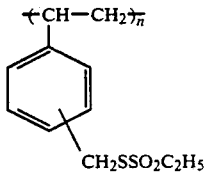
(2-24)
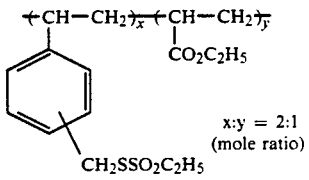
x:y = 2:1
(mole ratio)
(2-25)
$(CH_2)_4$
$SO_2S$
(3-1)
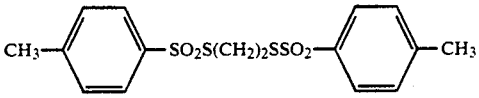
(3-2)
$C_2H_5SO_2SCH_2CH_2SO_2CH_2CH_2SSO_2C_2H_5$
(3-3)
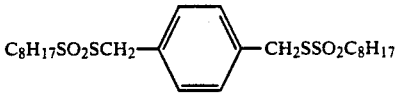
(3-4)
$C_2H_5SO_2SCH_2N(CH_2CH_2)NCH_2SSO_2C_2H_5$
$\quad\quad\quad TABLE A-continued
(3-9)
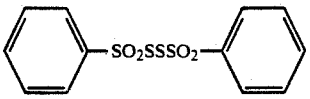
TABLE B-continued
U-1
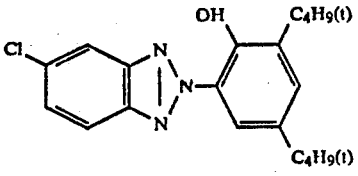
U-2
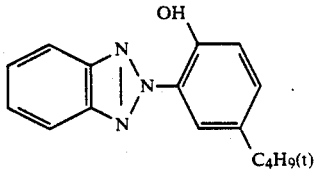
U-3
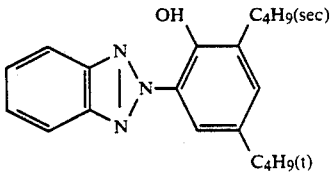
U-4
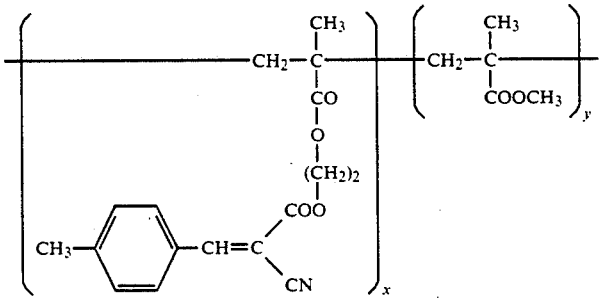
x:y = 7:3 (weight ratio)
U-5
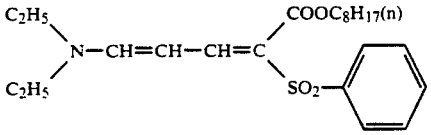
EX-1
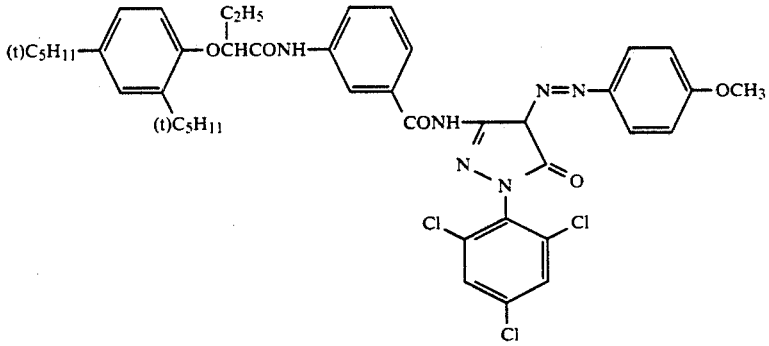

TABLE B-continued
EX-2
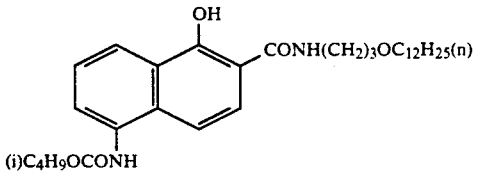
EX-3
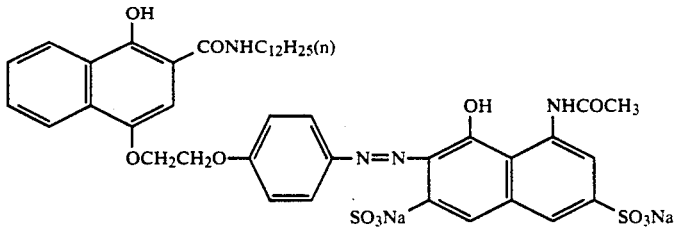
EX-4
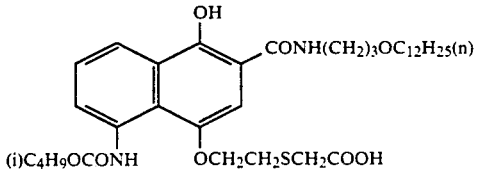
EX-5
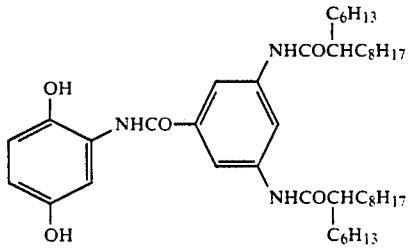
EX-6
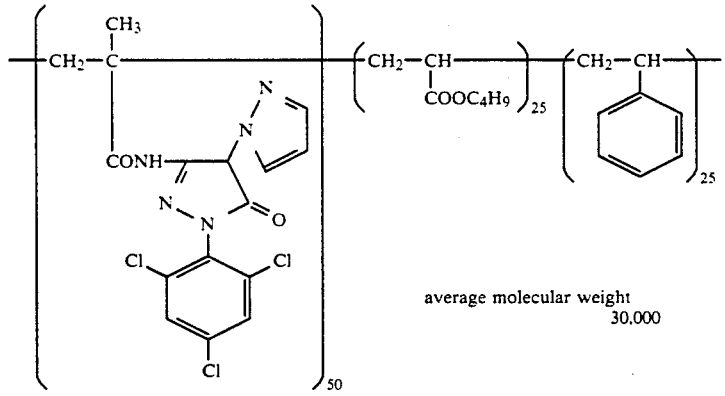
EX-7
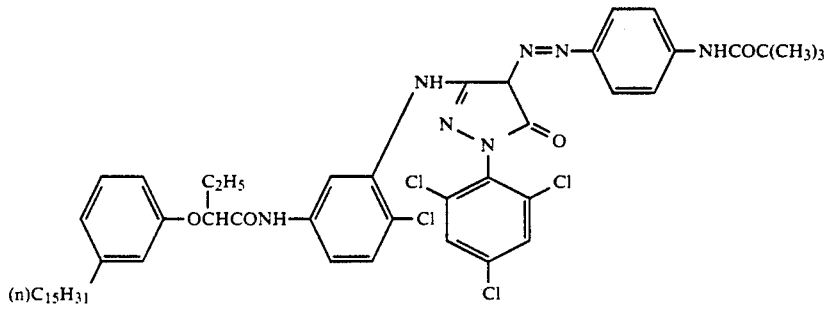

TABLE B-continued
EX-8
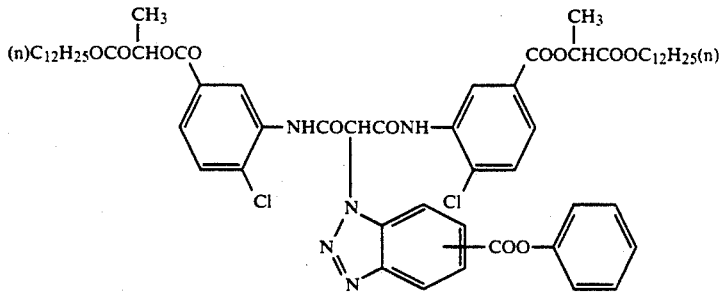
EX-9
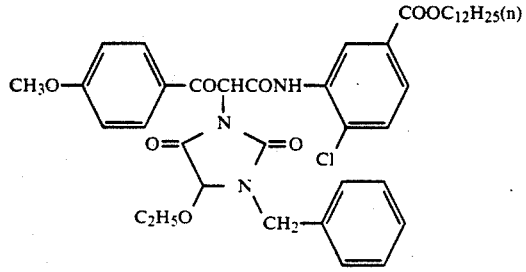
EX-10
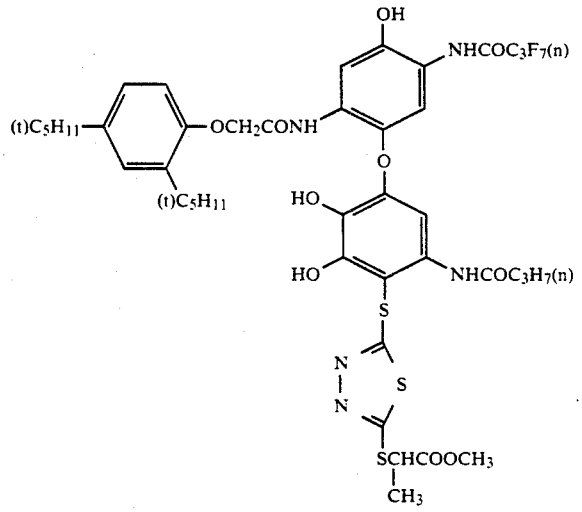
EX-11
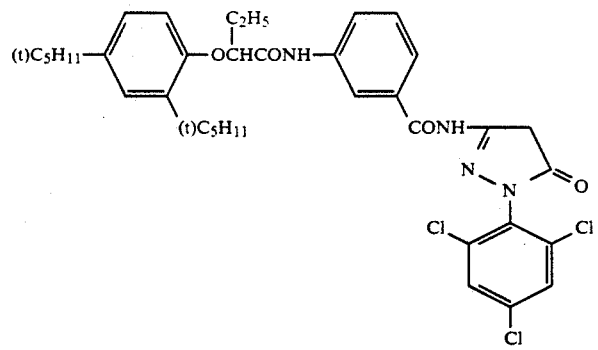
EX-12
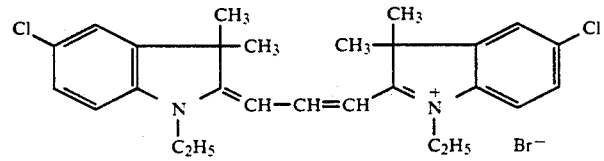

TABLE B-continued
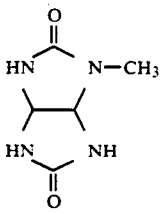
S-1
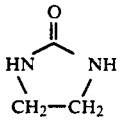
S-2
tricresyl phosphate — HBS-1
dibutyl phtalate — HBS-2
bis(2-ethylhexyl)phtalate — HBS-3
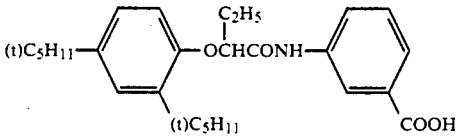
HBS-4
$CH_2{=}CHSO_2CH_2CONHCH_2$
$CH_2{=}CHSO_2CH_2CONHCH_2$ — H-1
Spectral Sensitizing Dyes
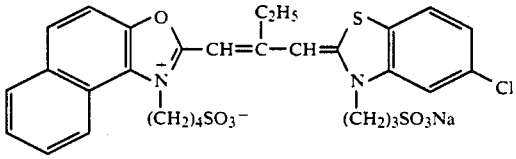
I
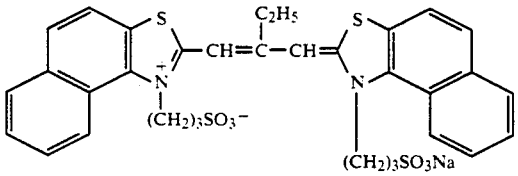
II
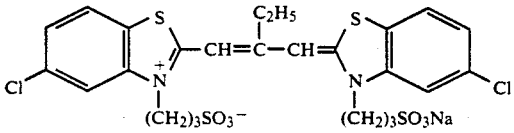
III
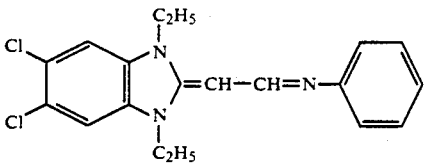
IV
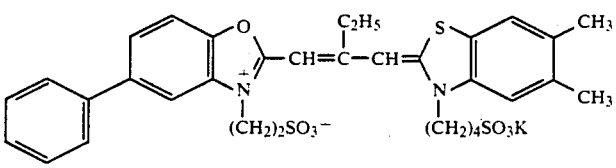
V TABLE B-continued
VI
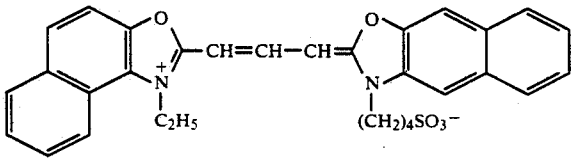
VII
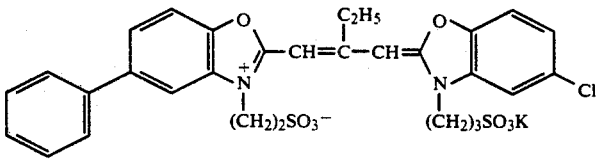
VIII
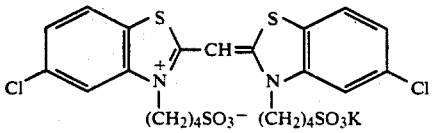
IX
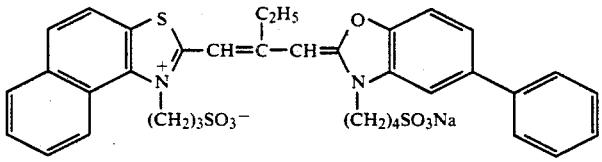
TABLE C
UV-1
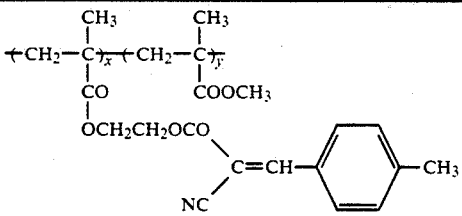
x/y = 7/3 (weight ratio)
UV-2
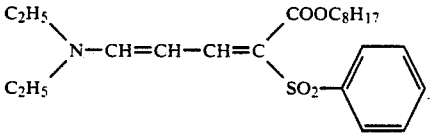
ExM-3
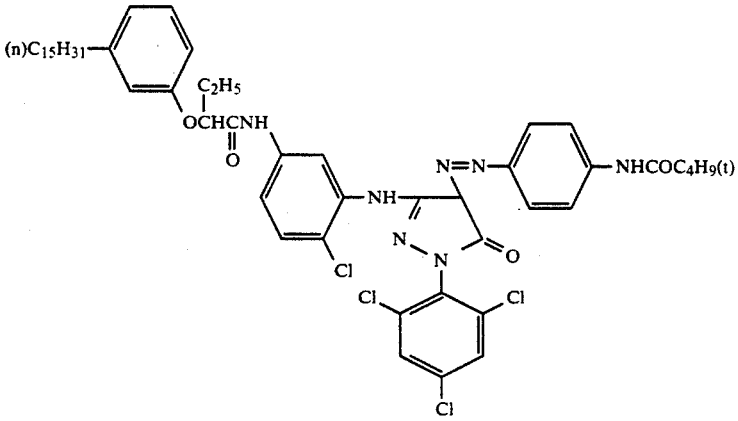

TABLE C-continued
ExC-1
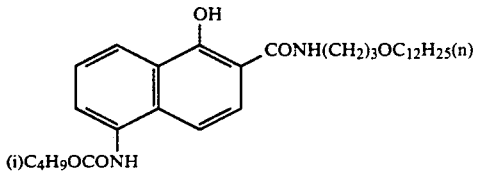
ExC-2
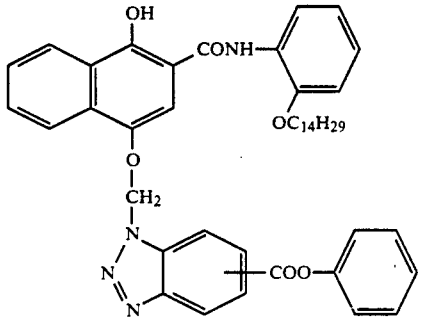
ExC-3
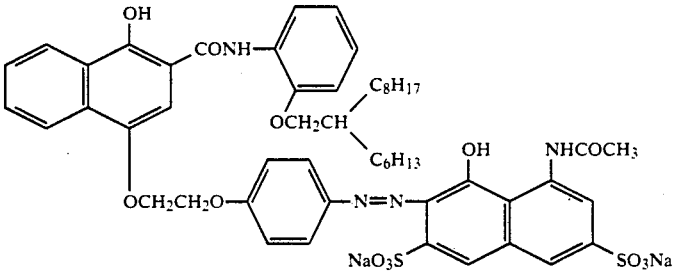
ExC-6
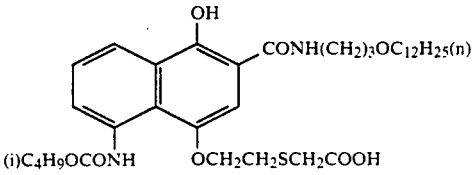
ExC-4
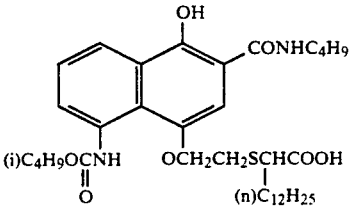
ExC-5
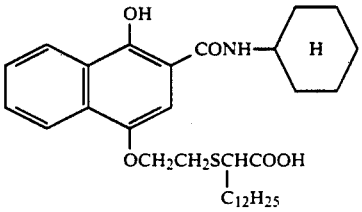

TABLE C-continued
ExM-1
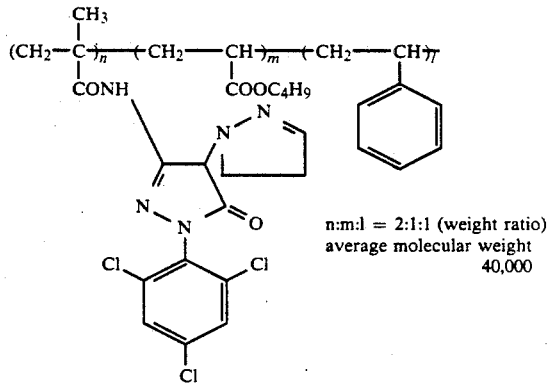
n:m:l = 2:1:1 (weight ratio)
average molecular weight
40,000
ExM-2
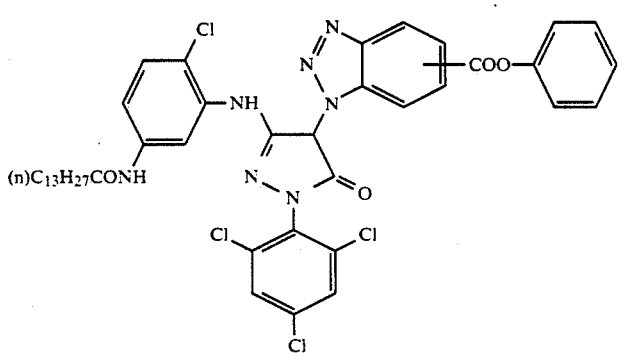
ExM-4
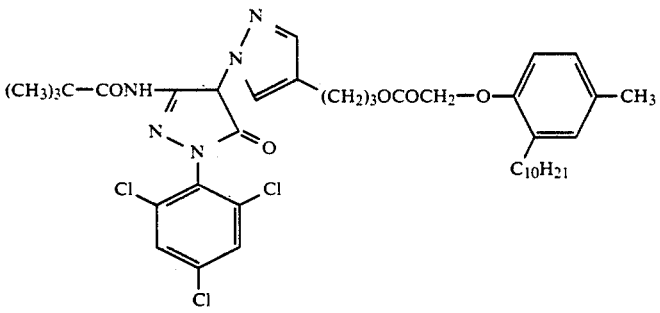
ExM-5
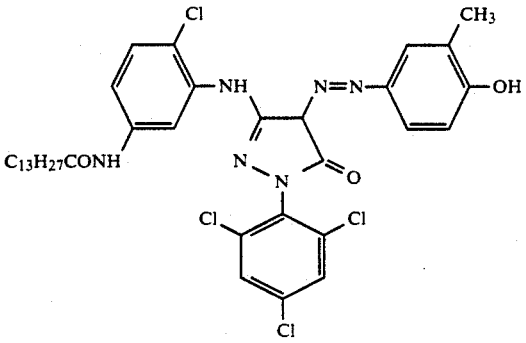

TABLE C-continued
ExY-1
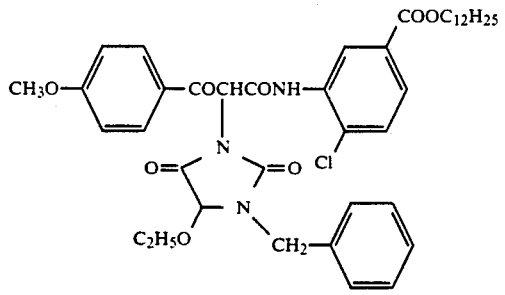
ExY-2
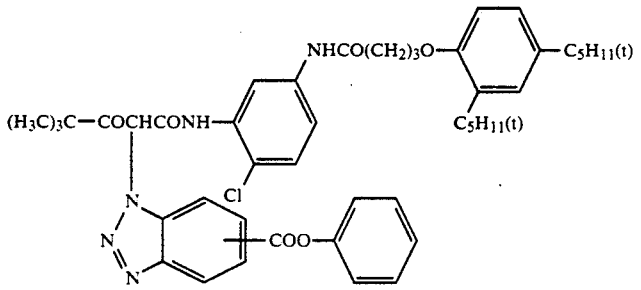
ExS-1
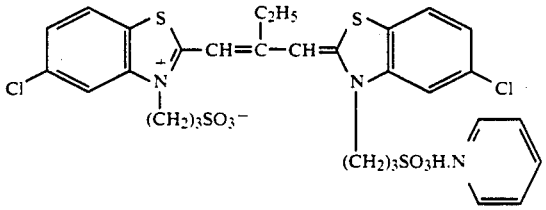
ExS-2
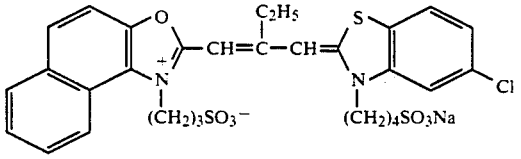
ExS-3
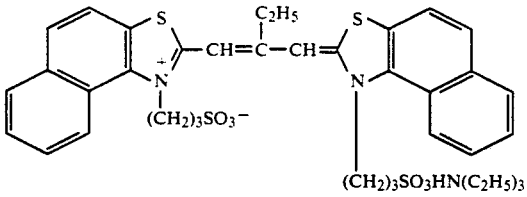
ExS-4
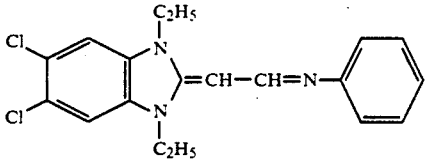
ExS-5
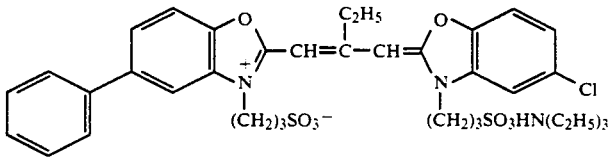

TABLE C-continued
ExS-6
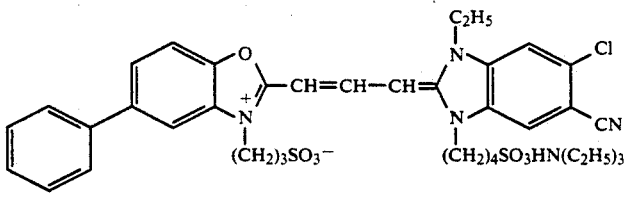
ExS-8
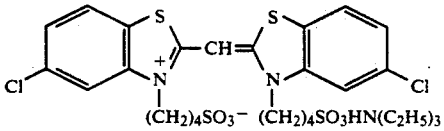
ExS-7
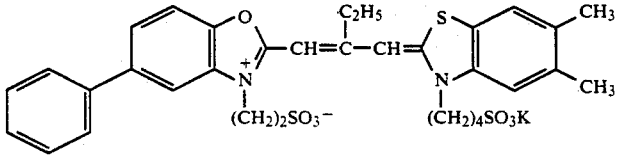
Solv-1
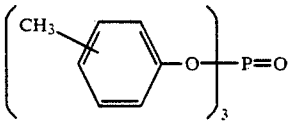
Solv-2
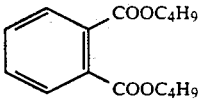
Solv-3
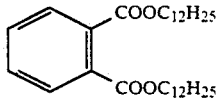
Solv-4
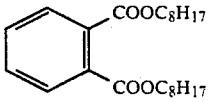
Solv-5
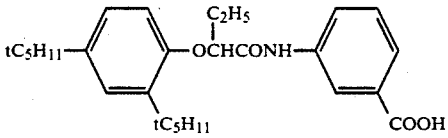
Cpd-1
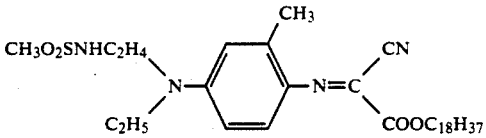
Cpd-2
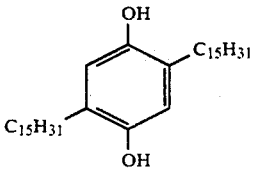

TABLE C-continued
| | |
|---|---|
| 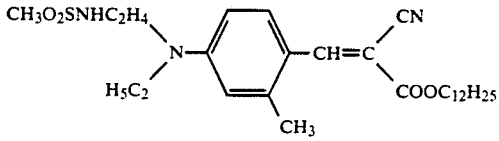 | Cpd-3 |
| 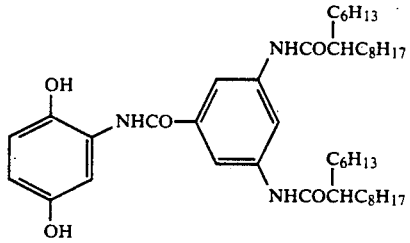 | Cpd-4 |
| 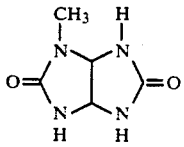 | Cpd-5 |
| $C_8F_{17}SO_2NHCH_2CH_2CH_2OCH_2CH_2N^+(CH_3)_3$ 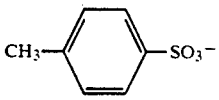 | W-1 |
| $CH_2{=}CHSO_2CH_2CONH{-}CH_2$<br>$CH_2{=}CHSO_2CH_2CONH{-}CH_2$ | H-1 |
TABLE D
| | |
|---|---|
| 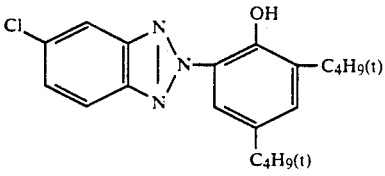 | UV-1 |
| 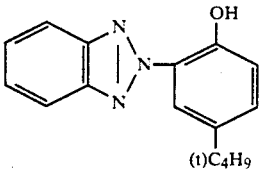 | UV-2 |
| 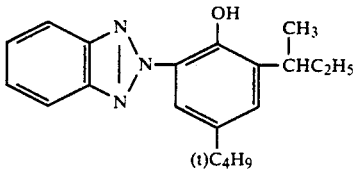 | UV-3 |
| 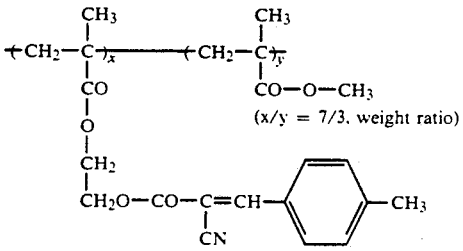 (x/y = 7/3, weight ratio) | UV-4 |

TABLE D-continued
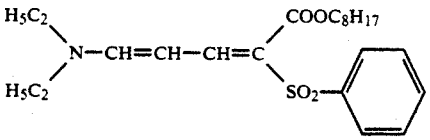
UV-5
tricresyl phosphate
Solv-1
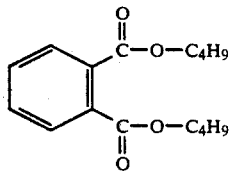
Solv-2
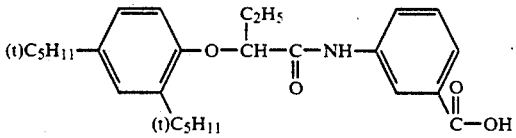
Solv-4
trihexyl phosphate
Solv-5
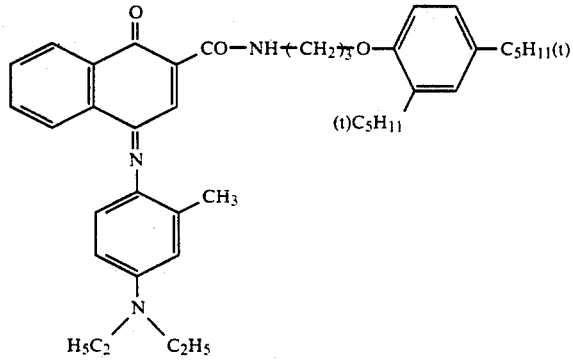
ExF-1
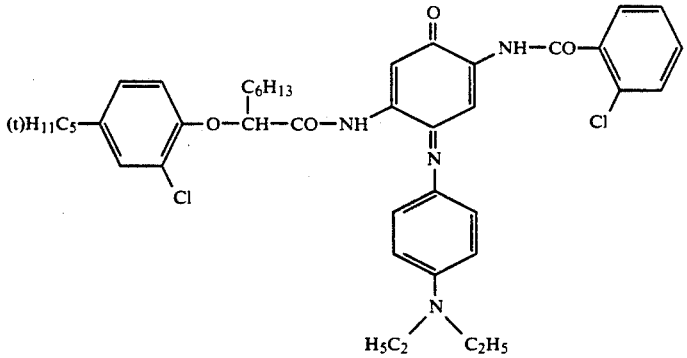
ExF-2
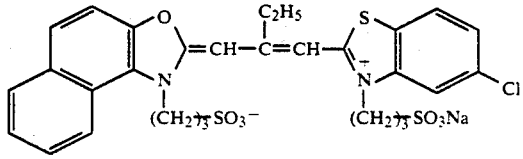
ExS-1

TABLE D-continued
ExS-2
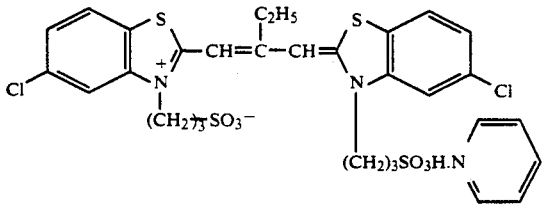
ExS-3
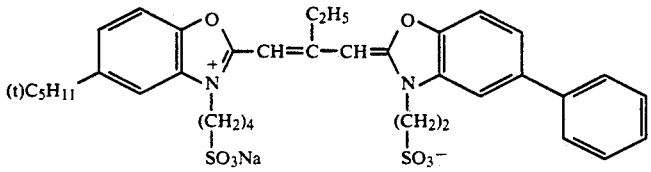
ExS-4
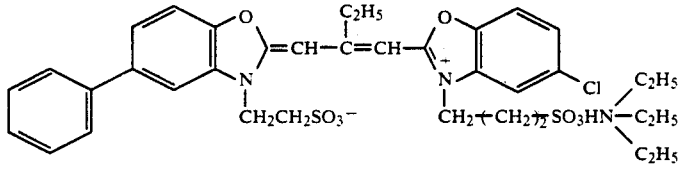
ExS-5
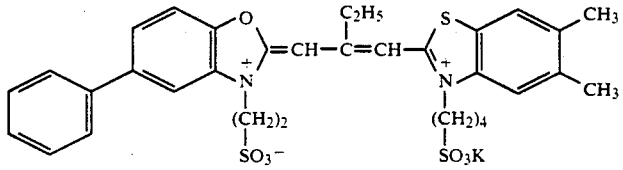
ExS-6
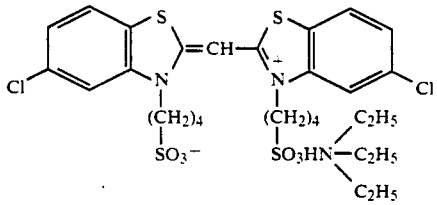
ExS-7
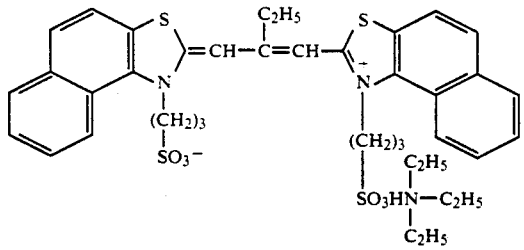
ExS-8
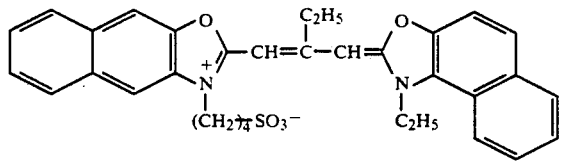
ExC-1
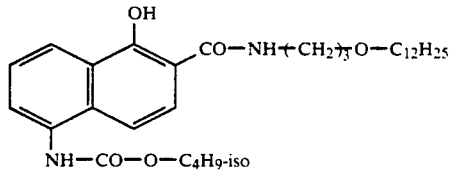

TABLE D-continued
ExC-2
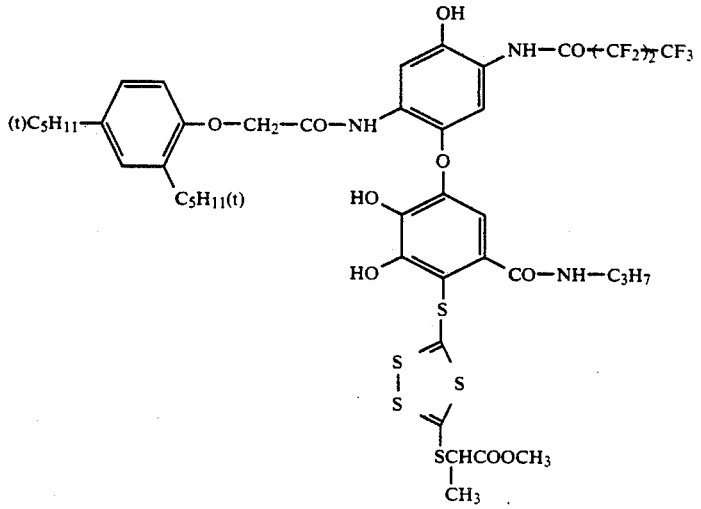
ExC-3
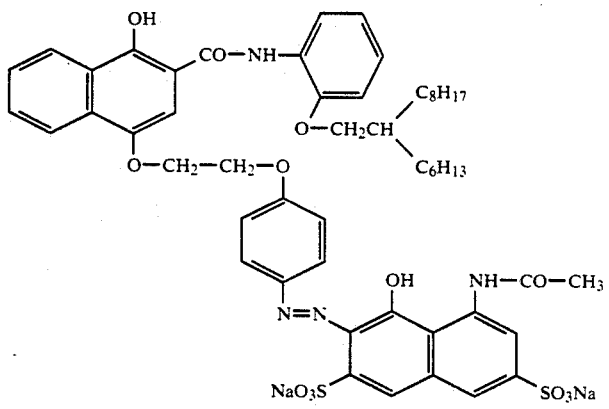
ExC-4
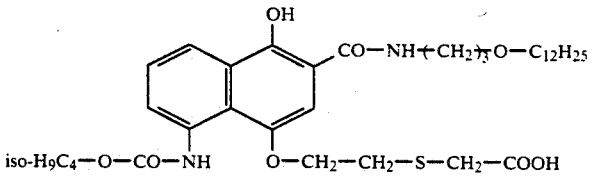
ExM-5
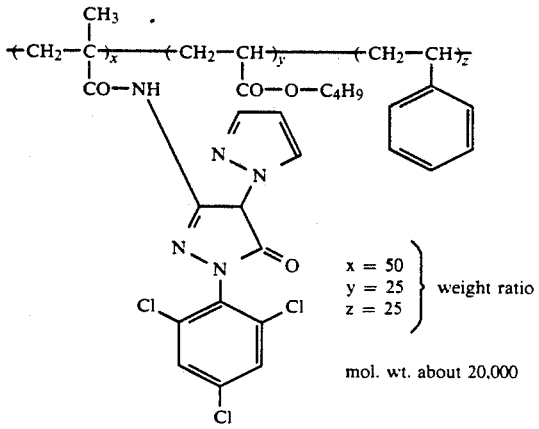

TABLE D-continued
ExM-6
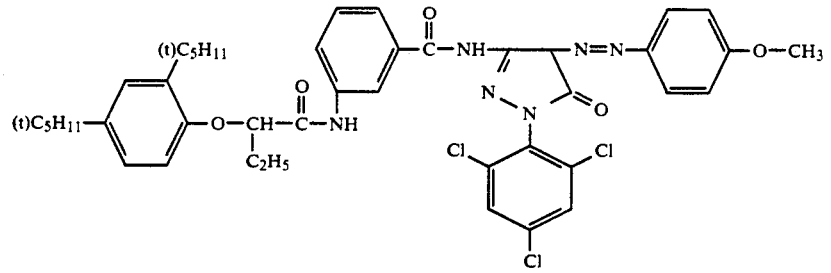
ExM-7
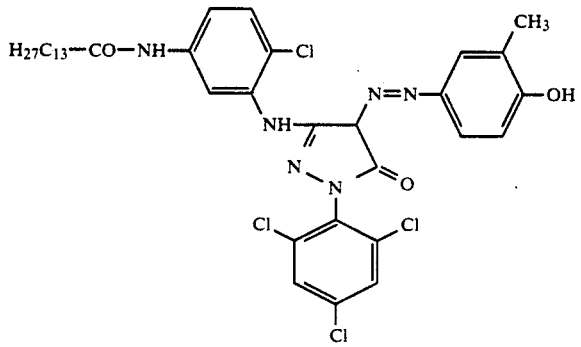
ExM-10
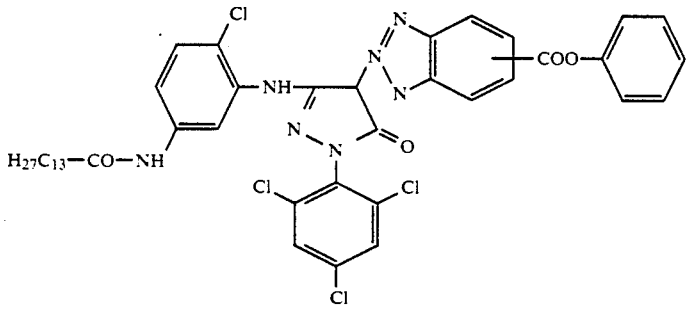
ExY-8
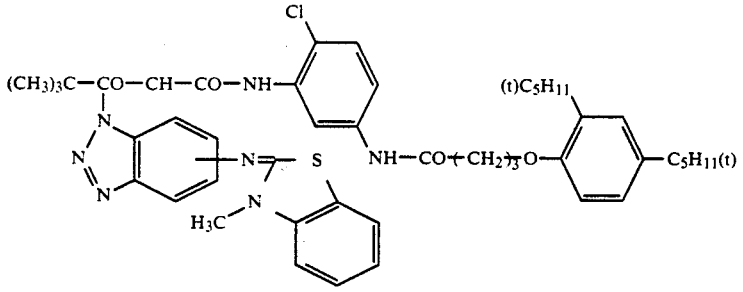
ExY-9
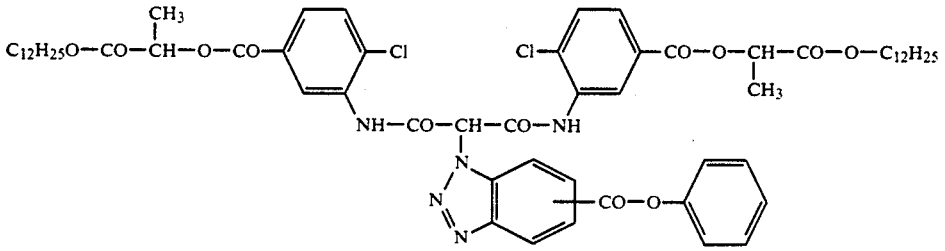

TABLE D-continued
ExY-11
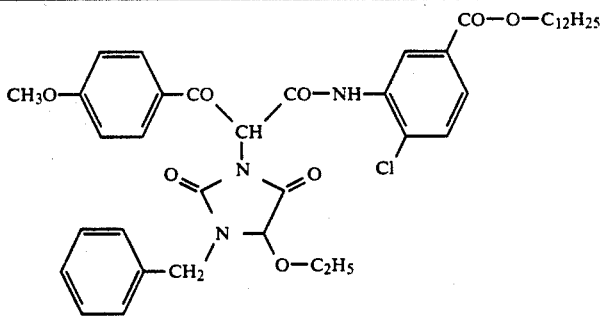
ExY-12
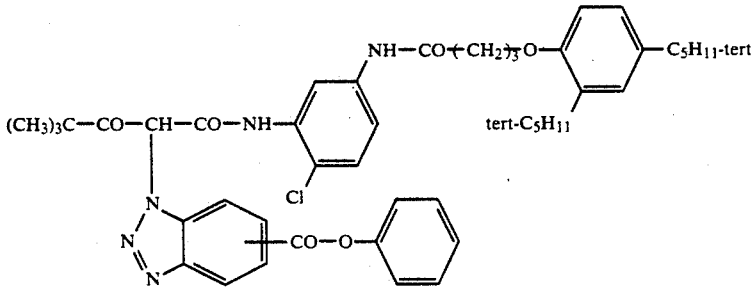
Cpd-1
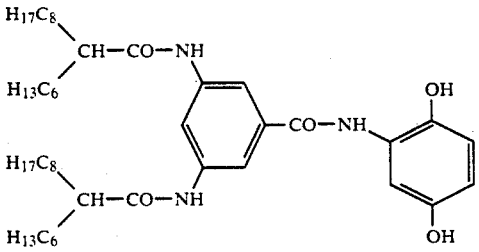
Cpd-2
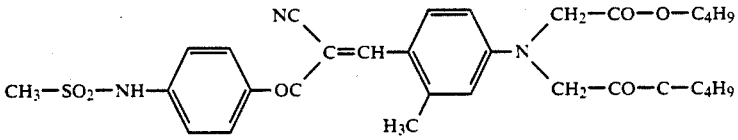
H-1
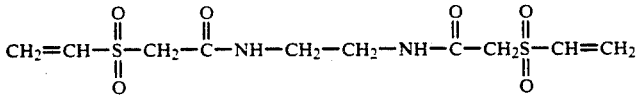
Cpd-5
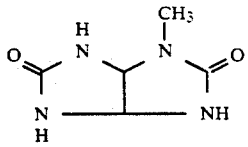
Cpd-3
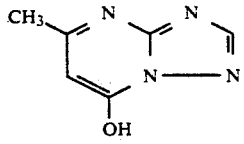
Cpd-4
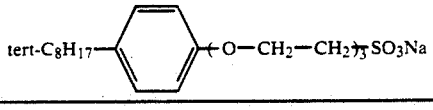
What is claimed is:
1. A color light-sensitive material comprising a transparent support having thereon at least one light-sensitive silver halide emulsion layer, wherein 50 weight percent or more of silver halide grains contained in said emulsion layer are the silver halide grains constituting the silver halide emulsion manufactured by performing reduction sensitization using $5\times10^{-5}$ to $1\times10^{-1}$ mol of at least one ascorbic acid or a derivative thereof per mol of silver halide during precipitation of silver halide grains in a process of manufacturing a silver halide emulsion, wherein reduction sensitization is performed in the presence of at least one of the compounds represented by formula (I):

$$R-SO_2S-M \quad (I)$$

wherein R represents an aliphatic group, an aromatic group, or a heterocyclic group, M represents a cation and the compounds represented by formula (I) can be polymers containing, as a repeating unit, divalent groups derived from structures represented by formula (I).

2. The color light-sensitive material according to claim 1, wherein R represents an alkyl group having 1 to 22 carbon atoms.

3. The color light-sensitive material according to claim 1, wherein R represents an aromatic group having 6 to 20 carbon atoms.

4. A silver halide color photographic light-sensitive material, wherein at least 50% of a total projected area of all silver halide grains in one emulsion layer containing silver halide grains reduction-sensitized by an ascorbic acid or at least one derivative thereof in the presence of at least one compound represented by formula (I) is occupied by tubular silver halide grains having an average aspect ratio of not less than 3.0, $$R-SO_2S-M \quad (I)$$

wherein R represents an aliphatic group, an aromatic group, or a heterocyclic group, M represents a cation and the compounds represented by formula (I) can be polymers containing, as a repeating unit, divalent groups derived from structures represented by formula (I).

5. The color light-sensitive material according to claim 4, wherein the ascorbic acid or derivative thereof is present in an amount of $5\times10^{-5}$ to $1\times10^{-1}$ mol per mol of silver halide.

6. A method of manufacturing a silver halide emulsion, which comprises performing reduction sensitization using $5\times10^{-5}$ to $1\times10^{-1}$ mol of at least one ascorbic acid or a derivative thereof per mol of silver halide during precipitation of silver halide grains in a process of manufacturing a silver halide emulsion, wherein reduction sensitization is performed in the presence of at least one of the compounds represented by formula (I):

$$R-SO_2S-M \quad (I)$$

wherein R, represents an aliphatic group, an aromatic group, or a heterocyclic group, M represents a cation, and the compounds represented by formula (I) can be polymers containing, as a repeating unit, divalent groups derived from structures represented by formula (I).

7. The method as in claim 6, wherein the reduction sensitization is performed by using ascorbic acid.

8. The method as in claim 6, wherein R represents an alkyl group having 1 to 22 carbon atoms.

9. The method as in claim 6, wherein R represents an aromatic group having 6 to 20 carbon atoms.

10. The method as in claim 6, wherein said reduction sensitization is performed by using $5\times10^{-4}$ to $1\times10^{-2}$ mol of ascorbic acid or a derivative thereof per mol of silver halide.

11. The method as in claim 6, wherein said reduction sensitization is performed by using $1\times10^{-3}$ to $1\times10^{-2}$ mol of ascorbic acid or a derivative thereof per mol of a silver halide.

12. The method as in claim 6, wherein the ascorbic acid or a derivative thereof is selected from the group consisting of L-ascorbic acid, sodium L-ascorbate, potassium L-ascorbate, DL-ascorbic acid, sodium D-ascorbate, L-ascorbic acid 6-acetate, L-ascorbic acid 6-palmitate, L-ascorbic acid 6-benzoate, L-ascorbic acid 5,6-diacetate and L-ascorbic acid 5,6-O-isopropylidene.

13. The method as in claim 6, wherein R represents an alkyl group having 1–22 carbon atoms or an alkenyl group or an alkynyl group having 2 to 22 carbon atoms.

14. The method as in claim 6, wherein R represents a heterocyclic group having a 3–15 membered ring having at least one element of nitrogen, oxygen, sulfur, selenium or tellurium and at least one carbon atom.

15. The method as in claim 6, wherein M is a metal ion or an organic cation.

16. The method as in claim 6, wherein a compound represented by formula (I) is added in an amount of $10^{-7}$ to $10^{-1}$ mol per mol of silver halide.

* * * * *